US006227661B1

(12) United States Patent
Hayakawa

(10) Patent No.: US 6,227,661 B1
(45) **Date of Patent: *May 8, 2001**

(54) INK-JET PRINTER

(75) Inventor: Hitoshi Hayakawa, Nagano (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/033,706

(22) Filed: Mar. 3, 1998

(30) Foreign Application Priority Data

| | | |
|---|---|---|
| Mar. 3, 1997 | (JP) | 9-063747 |
| Mar. 3, 1997 | (JP) | 9-063748 |
| Feb. 6, 1998 | (JP) | 10-041391 |
| Feb. 6, 1998 | (JP) | 10-041392 |

(51) Int. Cl.[7] ..... B41J 2/175
(52) U.S. Cl. ..... 347/86
(58) Field of Search ..... 347/85, 86, 87, 347/36, 30, 31

(56) References Cited

U.S. PATENT DOCUMENTS

| | | | | |
|---|---|---|---|---|
| 4,695,824 | | 9/1987 | Tazaki | 347/86 |
| 4,878,069 | | 10/1989 | Kiyohara | 347/86 |
| 4,965,596 | | 10/1990 | Nagoshi et al. | 347/36 |
| 5,023,629 | * | 6/1991 | Kiyohara | 347/36 |
| 5,221,935 | * | 6/1993 | Uzita | 347/36 |
| 5,315,317 | * | 5/1994 | Terasawa et al. | 347/85 |
| 5,350,929 | * | 9/1994 | Meyer et al. | 250/573 |
| 5,400,066 | | 3/1995 | Matsumoto et al. | 347/86 |
| 5,523,780 | * | 6/1996 | Hirosawa et al. | 347/86 |
| 5,886,720 | * | 3/1999 | Sasaki | 347/86 |

FOREIGN PATENT DOCUMENTS

| | | |
|---|---|---|
| 442528 | 8/1991 | (EP) . |
| 480473 | 4/1992 | (EP) . |
| 0 568 175 | 11/1993 | (EP) . |
| 0 639 462 | 2/1995 | (EP) . |
| 0 699 533 | 3/1996 | (EP) . |
| 0 737 584 | 10/1996 | (EP) . |
| WO 90 00971 | 2/1990 | (WO) . |
| 96/347533 | 11/1996 | (WO) . |

OTHER PUBLICATIONS

Patent Abstracts of Japan, vol. 14, No. 567 (M–1059), 2–241748, Sep. 26, 1990.

Patent Abstracts of Japan, vol. 97, No. 6, Feb. 2, 1997, JP 09 029982 A.

* cited by examiner

*Primary Examiner*—N. Le
*Assistant Examiner*—Anh T. N. Vo
(74) *Attorney, Agent, or Firm*—Sughrue, Mion, Zinn, Macpeak & Seas, PLLC

(57) ABSTRACT

An ink-jet printer which includes ink cartridges installed in an installed part provided on the body of the printer so that the ink cartridges can be detached for supplying ink to an ink jet head. The cartridges are arranged in a staircase manner as viewed from the top, and a waste ink absorber for absorbing ink forcedly sucked outside the head via a nozzle when the nozzle of the head is clogged is arranged in a position in which an ink droplet dropped from an ink supply needle can be absorbed under the installed part. As a result, the width of the ink-jet printer is reduced as is the number of parts.

29 Claims, 24 Drawing Sheets

FIG.7

FREQUENCY OF USE OF INK(Y,M,C,K) IN PRINT

| | K(BLACK) | M(MAGENTA) | C(CYAN) | Y(YELLOW) |
|---|---|---|---|---|
| FULL COLOR PRINTING | 5% | 40% | 30% | 25% |
| GENERAL DOCUMENT | 70% | 10% | 10% | 10% |
| AVERAGE | 37.5% | 25% | 20% | 17.5% |

INK-JET PRINTER

BACKGROUND OF THE INVENTION

1. Field of the Invention

The present invention relates to an ink-jet printer. Particularly, the present invention relates to the arrangement of ink cartridges. The present invention also relates to the arrangement of an ink absorber.

2. Related Art

Generally, an ink-jet printer is provided with an ink jet head for jetting an ink droplet from a nozzle toward a recording medium such as paper and an ink cartridge for supplying ink to the head.

Various cartridges are known, such as the type mounted on a carriage together with a head and a type installed in a printer so that the cartridge can be detached.

In an ink-jet printer adopting the type of cartridge installed in the printer so that it can be detached, an operating lever and a loading mechanism respectively for attaching or detaching the ink cartridges are eliminated to reduce the cost and minimize the structure.

As recent ink-jet printers enable printing in plural colors such as dichromatic printing and full color printing by four colors or more, plural ink cartridges are required.

FIGS. 23(*a*) and (*b*) show an example of a part in which cartridges are installed in an ink-jet printer adopting a type of cartridge installed in the printer so that the cartridges can be detached. FIG. 23(*a*) is a plan view and FIG. 23(*b*) is a front view.

Reference number 1 denotes a part in which cartridges are installed in which an ink supply needle 1*a* is provided. The installed part 1 is provided with a bottom plate 4 on which ink cartridges 2 are installed. A standing wall 5 is provided on the inner part of the bottom plate 4, and the above ink supply needle 1*a* is attached to the standing wall 5.

Each of the cartridges 2 is provided with a case 2*a,* an ink bag 2*b* housed in the case 2*a* and a rubber cap 2*c* secured to the ink bag 2*b*. As shown by arrow a1 in FIG. 23(*a*), the cartridges are installed by pushing them toward the installed part 1.

The ink supply needle 1*a* pierces the rubber cap 2*c* so that the end of the needles extends into the ink bag 2*b* when the cartridges 2 are pushed into the installed part 1. As a result, ink in the bag 2*b* is supplied to a head (not shown) via the ink supply needle 1*a* and an ink tube 3 connected to the needle 1*a*.

When the cartridges 2 are detached, they are moved in a direction shown by arrow a2. A part 2*d* for grasping the cartridges is provided on the case 2*a* for extracting the cartridges.

As is clear from FIGS. 23(*a*) and (*b*), in the above printer, plural colors of ink cartridges 2 (Y, M, C and K) are arranged in parallel. Ink for yellow, magenta, cyan and black is housed in respective ink bags 2*b* in the ink cartridges 2Y, 2M, 2C and 2K.

In the meantime, when failure of dot generation occurs when a nozzle of a head is clogged in an ink-jet printer, the nozzle face of the head is normally capped. Ink in the head is then forcedly discharged outside the head by sucking with a pump via the cap and a nozzle. The ink discharged from the pump is discharged in a waste ink absorber as waste ink. In the above printer, as shown in FIGS. 24(*a*) and 24(*b*), a waste ink absorber 6 is arranged on the side of the cartridges 2.

When the above cartridges are installed or detached, ink may drop from the ink supply needle 1*a*. Thus, the inside of a printer becomes contaminated and, in an extreme case, the ink may flow out of the printer.

To prevent such a situation, an ink absorber 7, different from the above waste ink absorber 6, is arranged under the ink supply needle 1*a*. In FIG. 24(*b*), reference number 3*d* denotes an aperture provided in the bottom plate 4. Ink which drips from the ink supply needle 1*a* is absorbed in the ink absorber 7 through the aperture 3*d*.

The above ink-jet printer has the following problems:

Problem 1

As plural ink cartridges 2 are only arranged in parallel in the above ink-jet printer, an interval L between the cartridges 2 must be large to facilitate holding a cartridge 2 when it is installed or detached. Therefore, the width of the printer is increased.

Problem 2

It is desirable in an ink-jet printer that a metallic tube be used for an ink tube 3 connected to the ink supply needle 1*a* for supplying ink in the bag 2*b* to a head. If a metallic tube is used, an L-type tube (for example, a tube bent to the left in FIG. 23(*a*)) may be required for the convenience of tube arrangement.

However, as plural ink cartridges 2 are only arranged in parallel in the ink-jet printer shown in FIGS. 23(*a*) and (*b*), a different type of tube (a tube different in the length in the direction shown by the arrow a1 in FIG. 23(*a*)) is required to prevent interference between tubes if an L-type tube is utilized.

Problem 3

In the ink-jet printer shown in FIGS. 24(*a*) and (*b*), since the additional ink absorber 7 (i.e., in addition to the waste ink absorber 6) is required under the ink supply needle 1*a,* the number of parts is increased.

Problem 4

In the ink-jet printer shown in FIGS. 24(*a*) and (*b*), as the waste ink absorber 6 is arranged on the side of the cartridges 2, the width of the printer is increased.

Problem 5

In the ink-jet printer shown in FIGS. 24(*a*) and (*b*), as only one ink aperture 3*d* is provided per one cartridge 2 on the bottom plate 4 of the installed part 1, the bottom face of the cartridges 2 may be extremely contaminated by ink not injected into the aperture 3*d*.

Problem 6

In the ink-jet printer shown in FIGS. 24(*a*) and (*b*), since an ink absorbing means is not provided adjacent the standing wall 5, to which the ink supply needle 1*a* is provided, the front face of the cartridges 2 may become contaminated by ink which drops on the standing wall 5 from the ink supply needle 1*a*.

A first object of the present invention is to provide an ink-jet printer in which the interval between cartridges is reduced, in order to solve the above problem 1.

A second object is to provide an ink-jet printer which enables the shared use of an L-type metallic tube to solve the above problem 2.

A third object is to provide an ink-jet printer which has a reduced number of parts to solve the above problem 3.

A fourth object is to provide an ink-jet printer having a reduced width to solve the above problem 4.

A fifth object is to provide an ink-jet printer which can prevent the bottom face of each of the cartridges from being excessively contaminated to solve the above problem 5.

A sixth object is to provide an ink-jet printer which can prevent the front face of each of the cartridges from being excessively contaminated to solve the above problem 6.

SUMMARY OF THE INVENTION

An ink-jet printer according to the present invention to achieve the above first object is provided with the a printer body, an ink jet head provided to the body of the printer for jetting an ink droplet from a nozzle and plural ink cartridges installed in an installed part provided to the body of the printer so that they can be detached for supplying ink to the ink jet head with them installed, and characterized in that the plural ink cartridges are provided with a holding part at the respective one ends and the respective one ends are arranged like a staircase with the plural ink cartridges installed in the installed part. The above plural ink cartridges supply ink in different color and it is desirable that a cartridge for supplying ink in a color which is most frequently used is constituted so that it is the largest. Further, it is desirable that the cartridges are constituted so that they are larger in the order of the cartridges for supplying ink in a color higher in the frequency of use.

Another ink-jet printer to achieve the above first object is provided with the body of the printer, an ink jet head provided to the body of the printer for jetting an ink droplet from a nozzle and plural ink cartridges installed in an installed part provided to the body of the printer so that they can be detached for supplying ink to the ink jet head with them installed, and characterized in that the plural ink cartridges are provided with a holding part at the respective one ends and the respective one ends are arranged zigzag with the plural ink cartridges installed in the installed part.

The above holding part is constituted as a finger grasping part for grasping fingers on it when a cartridge is detached from the installed part and it is desirable that the side on which fingers are put of the finger grasping part is formed on the side not opposite to an adjacent cartridge at the above one end.

Further, the other ink-jet printer to achieve the above first object is provided with the body of the printer, an ink jet head provided to the body of the printer for jetting an ink droplet from a nozzle and at least two ink cartridges installed in an installed part provided to the body of the printer so that they can be detached for supplying ink to the ink jet head with them installed, and characterized in that these two ink cartridges are provided with a finger grasping part for grasping fingers on it when a cartridge is detached from the installed part at the respective one ends and the side on which fingers are put of the finger grasping part is formed on the side not opposite to an adjacent cartridge at the respective one ends.

An ink-jet printer to achieve the above second object is provided with the body of the printer, an ink jet head provided to the body of the printer for jetting an ink droplet from a nozzle and plural ink cartridges installed in an installed part provided to the body of the printer so that they can be detached for supplying ink to the ink jet head with them installed, and characterized in that the plural ink cartridges are arranged with them installed in the installed part so that the respective ends on the installed sides are like a staircase.

Further, an ink-jet printer to achieve the above first and second objects simultaneously is provided with the body of the printer, an ink jet head provided to the body of the printer for jetting an ink droplet from a nozzle and plural ink cartridges installed in an installed part provided to the body of the printer so that they can be detached for supplying ink to the ink jet head with them installed, and characterized in that these plural ink cartridges are provided with a holding part at the respective one ends, the respective one ends are arranged like a staircase with them installed in the installed part and the respective ends on the installed sides which are other ends are also arranged like a staircase.

An ink-jet printer to achieve the above third object is provided with the body of the printer, an ink jet head provided to the body of the printer for jetting an ink droplet from a nozzle, ink cartridges installed in an installed part provided to the body of the printer so that they can be detached for supplying ink to the ink jet head via an ink supply needle provided to the installed part with them installed and a waste ink absorber for absorbing ink forcedly discharged outside the head via the nozzle when the nozzle of the ink jet head is clogged, and characterized in that the waste ink absorber is arranged in a position in which ink dropped from the ink supply needle can be absorbed under the ink supply needle.

It is desirable that ink dropped from the ink supply needle and ink discharged outside the head from the nozzle of the ink jet head are absorbed in the waste ink absorber from the separate sides of the waste ink absorber. The above sentence that ink dropped from the ink supply needle and ink discharged outside the head from the nozzle of the ink jet head are absorbed in the waste ink absorber from the separate sides of the waste ink absorber means the following for example:

1) ink dropped from the ink supply needle is absorbed in the waste ink absorber from the upper side of the waste ink absorber and ink discharged outside the head from the nozzle of the ink jet head is absorbed in the waste ink absorber from the lower side of the waste ink absorber;

2) ink dropped from the ink supply needle is absorbed in the waste ink absorber from the front side of the waste ink absorber and ink discharged outside the head from the nozzle of the ink jet head is absorbed in the waste ink absorber from the rear side of the waste ink absorber; and 3) ink dropped from the ink supply needle is absorbed in the waste ink absorber from the left side of the waste ink absorber and ink discharged outside the head from the nozzle of the ink jet head is absorbed in the waste ink absorber from the right side of the waste ink absorber.

The above installed part can be constituted so that it is provided with a bottom plate on which the above ink cartridges are laid, a drain opening for ink dropped from the ink supply needle is formed on the bottom plate and an ink passage for guiding ink from the faucet to the waste ink absorber is provided.

An ink-jet printer to achieve the above third and fifth objects simultaneously is characterized in that the above plural drain openings are provided in a direction in which an ink cartridge is installed or detached. It is desirable that the width of at least one of the above plural drain openings is formed so that it is larger than the width of the ink cartridge.

In the meantime, an ink-jet printer to achieve the above third and fourth objects simultaneously is constituted so that the above installed part is provided with a bottom plate on which the above ink cartridges are laid, a drain opening for ink dropped from the ink supply needle is formed on the bottom plate and the waste ink absorber is arranged under the bottom plate. It is desirable that the upper surface of the waste ink absorber is in contact with at least a part of the lower surface of the bottom plate. Further, it is desirable that the above part is the lower part of the edge of the faucet.

An ink-jet printer to achieve the third, fourth and fifth objects simultaneously is characterized in that a part of the waste ink absorber reaches the same plane as the upper surface of the bottom plate through the faucet. It is desirable that a part of the waste ink absorber is press-fitted to the bottom face of each ink cartridge installed in the installed part. It is desirable that plural drain openings are provided in a direction in which the ink cartridge is installed or detached. Further, it is desirable that the width of at least one of the plural drain openings is formed so that it is larger than the width of the ink cartridge.

An ink-jet printer to achieve the above sixth object is provided with the body of the printer, an ink jet head provided to the body of the printer for jetting an ink droplet from a nozzle and ink cartridges installed in an installed part provided to the body of the printer so that they can be detached for supplying ink to the ink jet head via an ink supply needle provided to the installed part with them installed, and characterized in that the ink supply needle is provided to a standing wall in the installed part and an ink absorber for absorbing ink dropped from the ink supply needle is provided to the standing wall. In this case, it is desirable that the front face of the ink above cartridge in a direction in which it is installed is in contact with the ink absorber with the ink cartridges installed in the installed part. It is also desirable that a part of the above waste ink absorber constitutes the ink absorber provided to the standing wall.

It is desirable to satisfactorily operate the above ink-jet printer that it is constituted so that when ink is forcedly discharged outside the head by a pump and the quantity of discharged ink in accordance with the rotational speed of the pump reaches predetermined quantity, a message that the waste ink absorber should be replaced is given to a user.

BRIEF DESCRIPTION OF THE DRAWINGS

FIG. 7 is a table showing the statistical general frequency of the use of ink (Y, M, C and K) of each color in an ink-jet printer which enables full color printing and the printing of a general document;

DETAILED DESCRIPTION OF PREFERRED EMBODIMENTS

Figure 1:
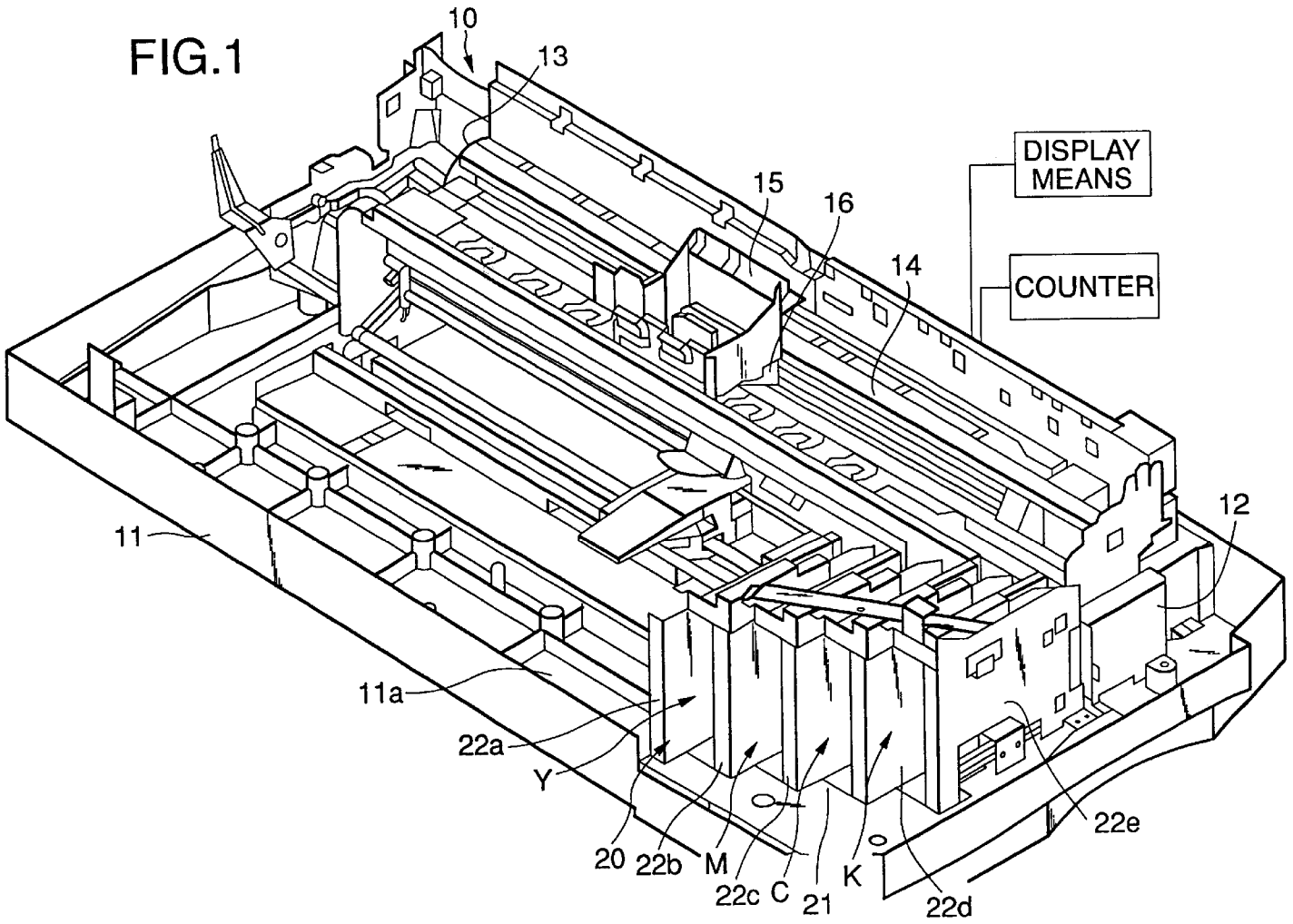
FIG. 1 is a perspective view of the internal structure showing a first embodiment of an ink-jet printer according to the present invention.

Referring to the drawings, the embodiments of the present invention will be described below.

First Embodiment

Figure 2A:
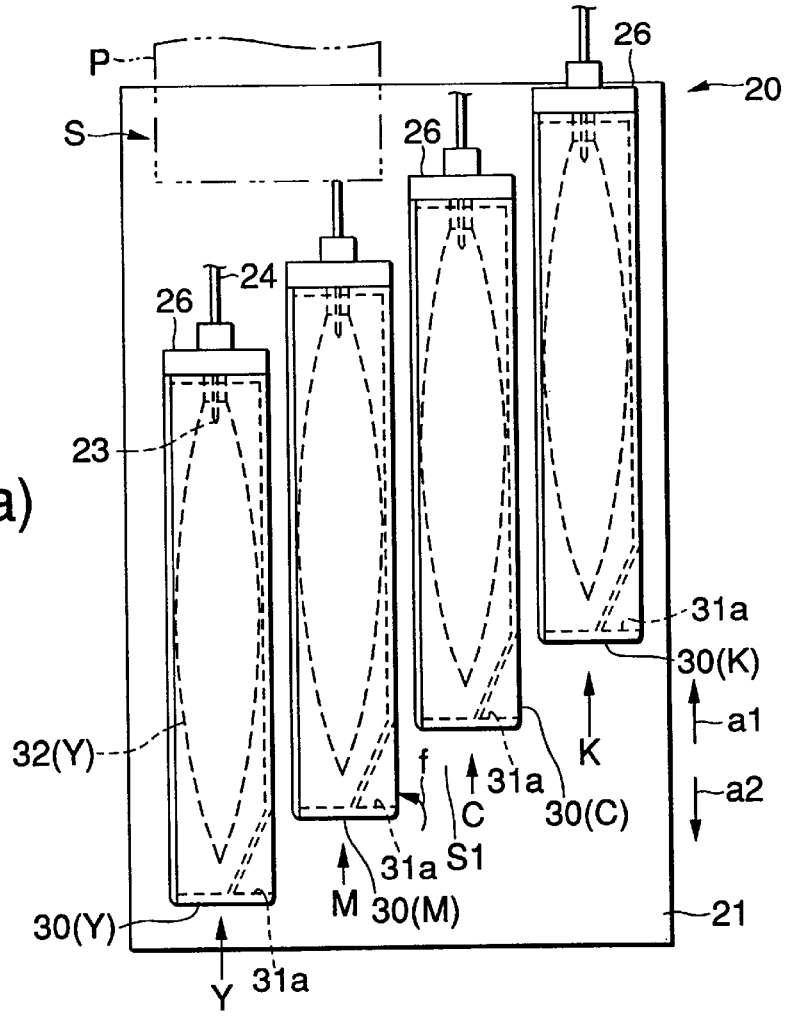
FIGS. 2(*a*) and (*b*) are schematic views showing a part in which ink cartridges are installed, in which FIG. 2(*a*) is a plan view and FIG. 2(*b*) is a front view.
Figure 2B:
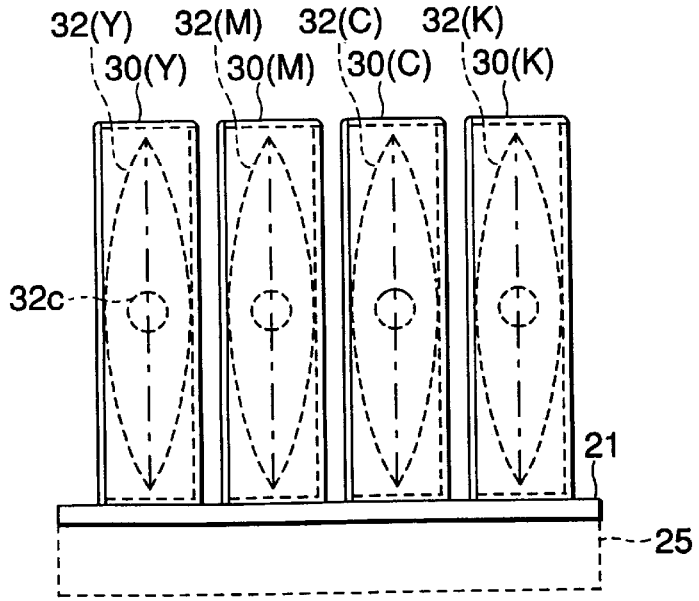

FIG. 1 is a perspective drawing of the internal structure showing a first embodiment of an ink-jet printer according to the present invention. FIGS. 2(*a*) and (*b*) are schematic drawings showing a part in which ink cartridges are installed, where FIG. 2(*a*) is a plan view and FIG. 2(*b*) is a front view.

As shown in FIG. 1, reference number 10 denotes the body of the printer in a state in which the upper case is detached.

Side frames 12 and 13 extend vertically from the lower case 11 of the printer body 10 and a carriage 15 is provided on a guide shaft 14 secured to these side frames 12 and 13 so that the carriage can be reciprocated (slid).

An ink jet head 16 is mounted on the carriage 15 and printing occurs on paper (not shown) by jetting an ink droplet from a nozzle of the head. When a nozzle of the head becomes clogged, a well-known pump unit P, shown in FIG. 2, is built in the printer body 10 to suction the ink and remove the clog. The pump unit P includes a counter C to count the number of revolutions of the pump. The pump unit is provided with at least a cap which can cover the nozzle surface of the head and a pump coupled to the cap. If clogging occurs, the pump unit is operated by the operation of a user or automatically (for example, after printing a predetermined quantity). In this process, the nozzle surface of the head is capped, ink in the head is forcedly sucked via the cap and the nozzle by the pump and the sucked ink is discharged outside the head. Ink discharged from the pump P is absorbed in a waste ink absorber, described below, as waste ink.

A part 20 in which the ink cartridges are installed is provided on the right side of the printer body 10. The installed part 20 includes a bottom plate 21 displaced from the bottom plate 11*a* of the lower case 11 and five guide plates 22*a*, 22*b*, 22*c*, 22*d* and 22*e* extending vertically from the bottom plate 21. Ink cartridges 30 (Y, M, C and K) are respectively inserted into spaces, Y, M, C and K respectively formed between these guide plates and installed as shown in FIG. 2. The guide plates 22*a*, 22*b*, 22*c*, 22*d* and 22*e* are provided in a stepped manner as viewed from the top. Therefore, the ink cartridges 30 (Y, M, C and K) respectively inserted into the spaces Y, M, C and K are also installed in a stepped manner as viewed from the top, as also shown in FIG. 2(*a*). In forming the cartridges 30, the cartridge 30 (Y) for yellow, the cartridge 30 (M) for magenta, the cartridge 30 (C) for cyan and the cartridge 30 (K) for black are prepared, and then an ink bag 32 (Y) in which yellow ink is filled, an ink bag 32 (M) in which magenta ink is filled, an ink bag 32 (C) in which cyan ink is filled and an ink bag 32 (K) in which black ink is filled are housed in the respective cases 31. A rubber cap 32*c* is then secured to each ink bag 32.

A standing wall 26, secured to the bottom plate 21, is provided at the back of each space Y, M, C, K and an ink supply needle 23 is secured to each standing wall 26. Therefore, when the cartridges 30 are pushed into the installed part and installed, as shown by an arrow a1 in FIG. 2(*a*), the ink supply needle 23 pierces the rubber cap 32*c* of the ink bag 32 so that the end is inserted in the ink bag 32 and ink in the bag 32 is supplied to the above head via the ink supply needle 23 and an ink tube 24 connected to the needle 23. That is, ink in four colors of Y, M, C and K is supplied to the head so that printing of a full color image is enabled.

When the cartridges 30 are detached, fingers grasp a finger grasping part 31*a* provided at one end of the cartridges 30 as a holding part and the cartridges are extracted in a direction shown by an arrow a2.

The finger grasping part 31*a* is constituted at the back of the right side of the cartridges 30 as a concave portion (a groove, the section of which is a triangle) in which fingers can be placed as shown by arrow f in FIG. 2(*a*). That is, the side on which fingers are placed of the finger grasping part 31*a* is formed on the side on which one end of the cartridges 30 (the rear end in this case) is not opposed by an adjacent cartridge. In other words, the finger grasping part 31*a* is constituted so that fingers can be easily placed in the finger grasping part 31*a* as shown by the arrow f utilizing space S1 formed on the side of the finger grasping part 31*a* by arranging each end at which the finger grasping part 31*a* is formed by the cartridges 30 like a staircase.

A waste ink absorber 25 is arranged under the above installed part 20. The waste ink absorber 25 is provided to absorb ink forcedly absorbed outside the head via a nozzle when the nozzle of the ink jet head is clogged as described above. Means for sucking ink is constituted by the above well-known pump unit. In this embodiment, as shown in FIG. 2(*a*), the installed part 20 is formed like a staircase and at least a part of the pump unit P is arranged in approximately triangular space S resulting from the staircase-like arrangement of the cartridges 30.

According to the above ink-jet printer, as plural ink cartridges 30 are installed like a staircase when they are viewed from the top, the cartridges 30 can be easily held and extracted without increasing an interval between the cartridges 30. Therefore, an interval between the cartridges 30 can be reduced and, as a result, the width of the printer can be narrowed.

In addition, as the installed part 20 is formed like a staircase and at least a part of the pump unit P is arranged in the approximately triangular space S made as a result of the staircase-like arrangement of the cartridges 30, the above space S is useful.

Figure 3:
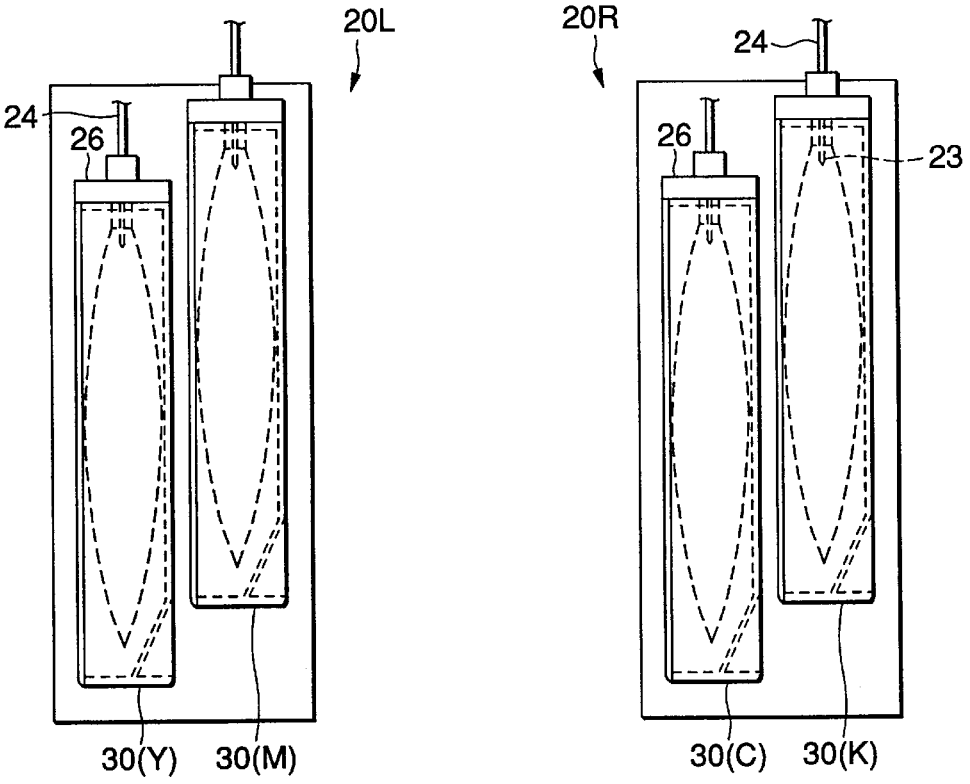
FIG. 3 is a plan view showing a transformed example.

The part arranged in the above approximately triangular space S is not limited to the pump unit P and any suitable member may be arranged. For example, as shown in FIG. 3, the installed part is separated into right and left parts (the separated installed part on the left side is shown as 20L and the installed part on the right side is shown as 20R) and the width of the printer can also be narrowed more by arranging the ink cartridges 30 in vacant space except a printing range such as the accelerating/decelerating area of the carriage 15.

As explained below, the cartridges 30 can also be arranged in a staircase-like manner as viewed from the side or from the top. However, if the cartridges are arranged as described above, the height of the ink supply needle 23 of each cartridge 30 (Y, M, C, K) is different and the staircase-like arrangement is not desirable because the water pressure head of ink supplied to the head is different in each color. However, according to this embodiment, the height of the ink supply needles 23 of cartridges 30 (Y, M, C, K) are the same and the staircase-like arrangement is desirable because the water pressure head of ink supplied to the head is also the same.

Second Embodiment

Figure 4:
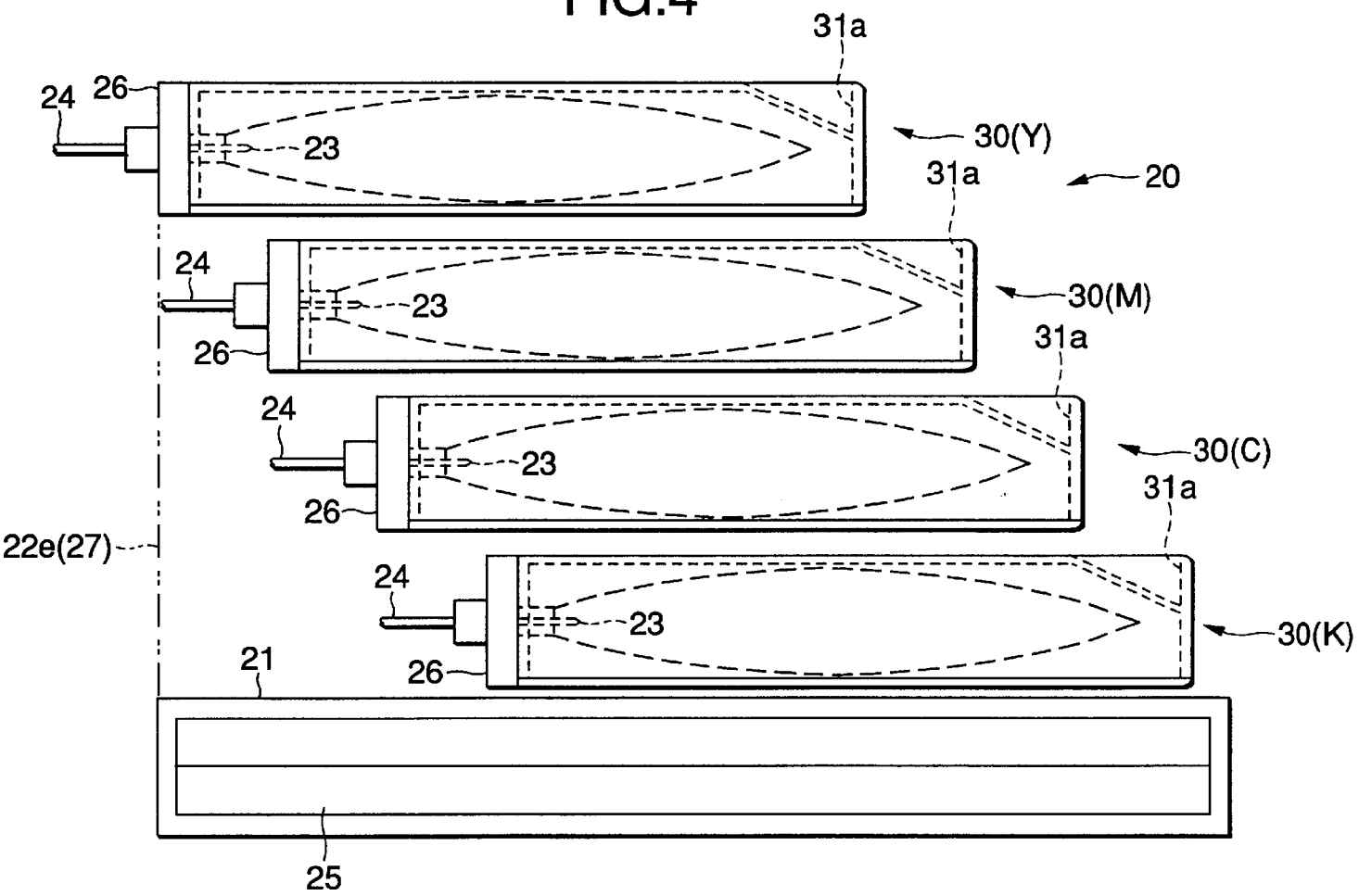
FIG. 4 is a left side view showing the main part of a part in which cartridges are installed in a second embodiment of the ink-jet printer according to the present invention.

FIG. 4 is a left side view showing the main part of the cartridge installed part in a second embodiment of the ink-jet printer according to the present invention. In FIG. 4, the same reference number is allocated to the same part or an equivalent part as to that in the above first embodiment.

This embodiment is different from the first embodiment in that cartridges 30 (Y, M, C and K) are arranged like a staircase when they are viewed from the left side.

A member 26 to which an ink supply needle 23 is attached is fixed to the guide plate 22*e* of an installed part 20 for example. According to such constitution, the length of the cartridges 30 in the installed direction (in a vertical direction in FIG. 4), that is, the height of the printer, can be reduced.

The cartridges 30 may be arranged like a staircase as shown in FIG. 4 when they are viewed from the front and the installed part may also be constituted so that the cartridges 30 are installed or detached from the right side of the printer body 10 shown in FIG. 1. In this case, the member 26 to which the ink supply needle 23 is attached is fixed to a plate 27 vertically provided at the back of the bottom plate 21 of the installed part 20, for example.

The cartridges 30 may be arranged like a staircase as shown in FIG. 4 when they are viewed from the top and the installed part may also be constituted so that the cartridges 30 are installed or detached from the right side of the printer body 10 shown in FIG. 1.

Further, the cartridges 30 may be arranged in a state in which FIG. 4 is turned by 90° counterclockwise when they are viewed from the front and the installed part may also be constituted so that the cartridges 30 are installed or detached from the top of the printer body 10 shown in FIG. 1.

Third Embodiment

Figure 5:
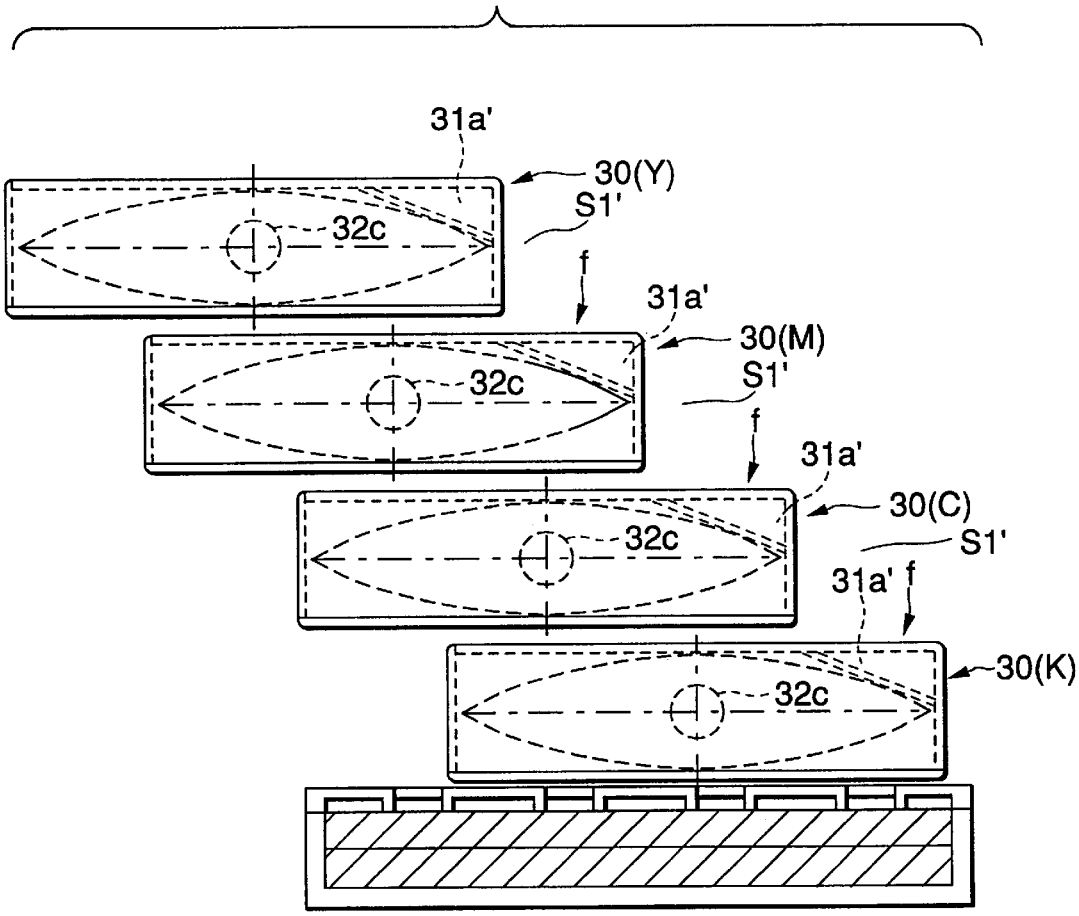
FIG. 5 is a front view showing the main part of a part in which cartridges are installed in a third embodiment of the ink-jet printer according to the present invention.

FIG. 5 is a front view showing the main part of a cartridges installed part in a third embodiment of the ink-jet printer according to the present invention. In FIG. 5, the same reference number is allocated to the same part or an equivalent part as to that in the above first embodiment.

This embodiment is different from the above first embodiment in that cartridges 30 (Y, M, C and K) extend crosswise and are arranged in a staircase-like manner when they are viewed from the front.

A finger grasping part 31*a*' is constituted on the right upper surface of the back of the cartridges 30 as a concave portion (a groove, the section of which is a triangle) in which fingers can be placed as shown by the arrow f. The finger grasping part 31*a*' is easily accessible due to the space S1' formed above the finger grasping part 31*a*' by arranging each end of the cartridges 30 with the finger grasping part 31*a*' like a staircase.

According to such constitution, the length of the cartridges 30 in the arranged direction (in a vertical direction in FIG. 5), that is, the height of the printer, can be reduced.

The cartridges 30 may also be arranged like a staircase as shown in FIG. 5 when they are viewed from the right side and the installed part may also be constituted so that the cartridges 30 are installed or detached from the right side of the printer body 10 shown in FIG. 1. The cartridges may also be arranged as shown in FIG. 5 when they are viewed from the top and the installed part may also be constituted so that the cartridges 30 are installed or detached from the top of the printer body 10 shown in FIG. 1. Further, the cartridges may also be arranged in a state in which FIG. 5 is rotated by 90□ clockwise when they are viewed from the top and the installed part may also be constituted so that the cartridges 30 are installed or detached from the top of the printer body 10 shown in FIG. 1.

Fourth Embodiment

Figure 6:
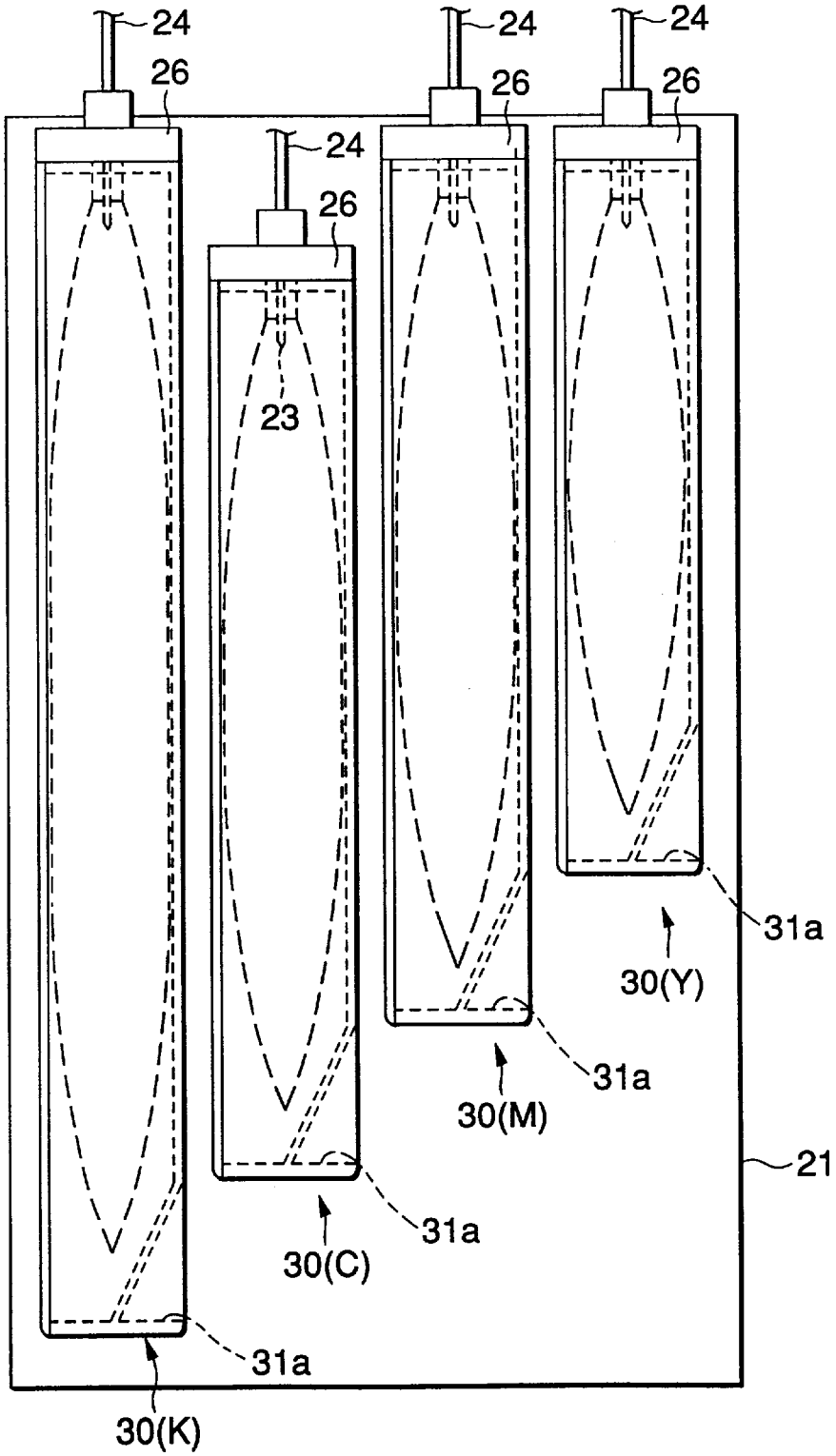
FIG. 6 is a plan view showing the main part of a part in which cartridges are installed in a fourth embodiment of the ink-jet printer according to the present invention.

FIG. 6 is a plan view showing the main part of a cartridges installed part in a fourth embodiment of the ink-jet printer according to the present invention. In FIG. 6, the same reference number is allocated to the same part or an equivalent part as to that in the above first embodiment.

This embodiment is different from the above first embodiment in that a cartridge 30K for supplying ink used most frequently, black ink in this case, is constituted so that it is the largest. A cartridge 30Y for supplying ink for yellow is constituted so that it is the smallest. A cartridge 30M for supplying ink for magenta and a cartridge 30C for supplying ink for cyan are constituted so that they are equal in size.

FIG. 7 is a table showing the statistical general frequency of the use of ink (Y, M, C, K) of each color in an ink-jet printer which enables full color printing and the printing of a general document as the printer in this embodiment.

The following is an explanation of the information contained in the table:

The general frequency of the use of ink in each color when a full color image is printed is as follows, black (K), 5%, magenta (M), 40%, cyan (C), 30% and yellow (Y), 25%.

The general frequency of the use of ink in each color when a general document is printed is as follows, black (K), 70%, and magenta (M), cyan (C) and yellow (Y) are each 10%.

Therefore, on an average, black (K) is 37.5%, magenta (M) is 25%, cyan (C) is 20% and yellow (Y) is 17.5%.

As is clear from the above description, the use of black (K) is the most frequent on the average.

According to the fourth embodiment, as the cartridge 30(K) for supplying black ink is used most frequently, that cartridge is the largest. Also, each end of the cartridges 30 (Y,M,C and K) with a holding part 31*a* is easily arranged in a staircase-like manner. That is, in this embodiment, only the position of an ink supply needle 23 for the ink cartridge 30(C) for cyan has to be displaced.

In addition, as the cartridge 30(K) for supplying black ink is the largest, the frequency of the replacement of cartridges 30(K) can be reduced.

The cartridges 30 may also be arranged in a state in which FIG. 6 is turned by 90° counterclockwise when they are viewed from the front and the installed part may also be constituted so that the cartridges 30 are installed or detached from the right side of the printer body 10 shown in FIG. 1. The cartridges 30 may also be arranged in a state in which FIG. 6 is turned by 90° counterclockwise when they are viewed from the left side and the installed part may also be constituted so that the cartridges 30 are installed or detached from the front of the printer body 10 shown in FIG. 1. Further, the cartridges may also be arranged in a state in which FIG. 6 is turned 180° when they are viewed from the right side and the installed part may also be constituted so that the cartridges 30 are installed or detached from the top of the printer body 10 shown in FIG. 1. Furthermore, the cartridges may also be arranged in a state in which FIG. 6 is turned 180□ when they are viewed from the front and the installed part may also be constituted so that the cartridges 30 are installed or detached from the top of the printer body shown in FIG. 1.

The arrangement of the cartridges 30 can also be changed in the first embodiment.

Fifth Embodiment

Figure 8:
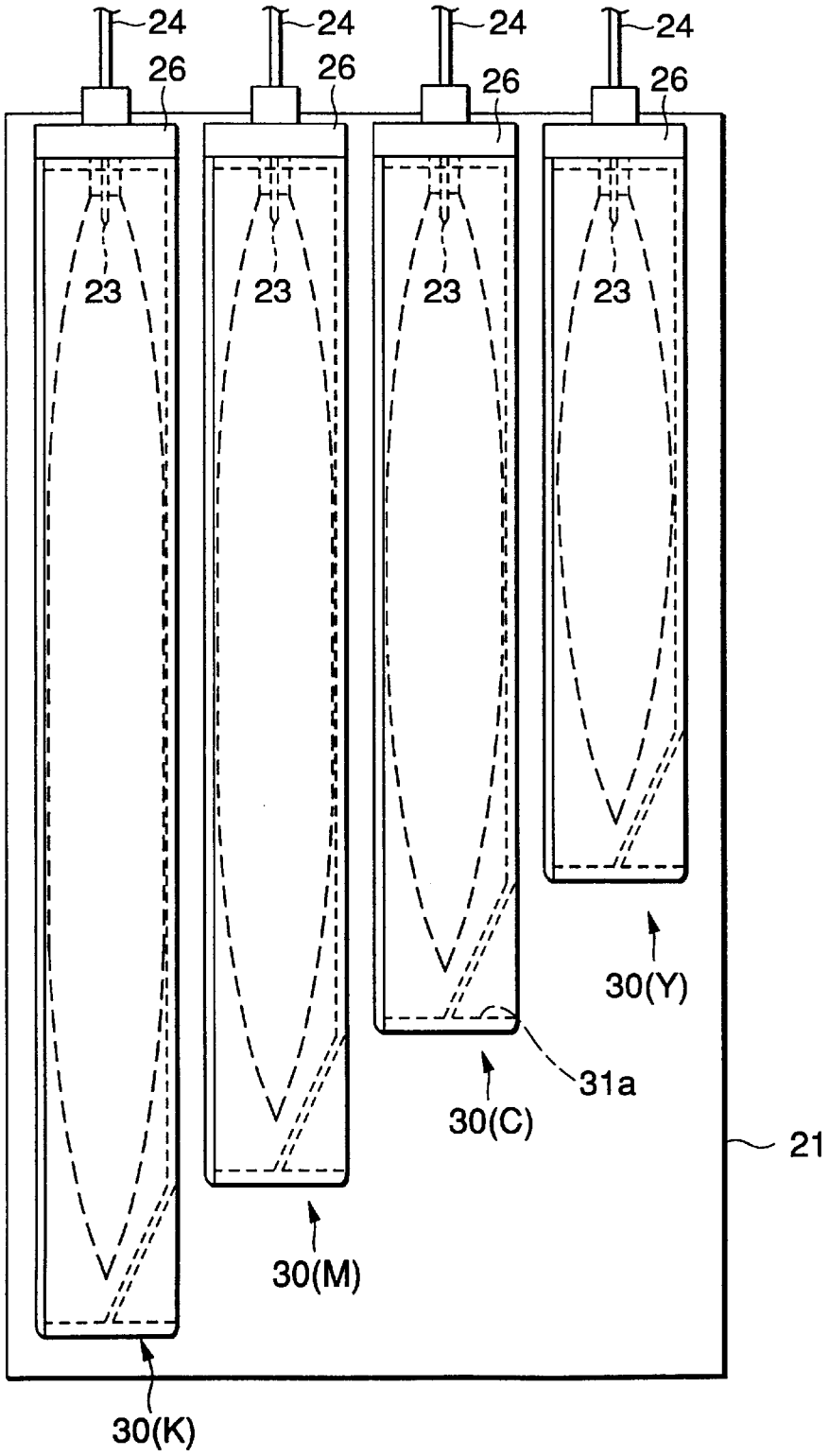
FIG. 8 is a plan view showing the main part of a part in which cartridges are installed in a fifth embodiment of the ink-jet printer according to the present invention.

FIG. 8 is a plan view showing the main part of a cartridge installed part in a fifth embodiment of the ink-jet printer according to the present invention. In FIG. 8, the same reference number is allocated to the same part or an equivalent part as to that in the above first embodiment.

This embodiment is different from the above first embodiment in that ink cartridges 30 (Y, C, M and K) are arranged so that their size is proportional to the higher frequency of use of each cartridge.

As is clear from the description related to FIG. 7, the general frequency of the use of ink of each color (Y, M, C, K) is increased in the order of Y, C, M and K. Therefore, in this embodiment, the cartridges are arranged so that the size is enlarged in the order of Y, C, M and K.

According to the fifth embodiment, as the cartridges are arranged so that the size increases in proportion to the frequency of use, the staircase-like arrangement of each one end with a holding part 31*a* of the cartridges 30 is further facilitated, compared with that in the above fourth embodiment. That is, in the fifth embodiment, the position of an ink supply needle 23 for each ink cartridge 30 (Y, C, M, K) is not required to be changed and each ink supply needle may be arranged in a row crosswise.

In addition, as the cartridges 30 (Y, C, M and K) are constituted so that the size increases in proportion to the frequency of the use, the frequency of the replacement of the cartridges can be reduced further, compared with that in the above fourth embodiment.

The cartridges 30 may also be arranged in a state in which FIG. 8 is turned by 90□ counterclockwise when they are viewed from the front and the installed part may also be constituted so that the cartridges 30 are installed or detached from the right side of the printer body 10 shown in FIG. 1. The cartridges may also be arranged in a state in which FIG. 8 is turned by 90□ counterclockwise when they are viewed from the left side and the installed part may also be constituted so that the cartridges 30 are installed or detached from the front of the printer body 10 shown in FIG. 1. Further, the cartridges may also be arranged in a state in which FIG. 8 is turned 180□ when they are viewed from the right side and the installed part may also be constituted so that the cartridges 30 are installed or detached from the top of the printer body 10 shown in FIG. 1. Furthermore, the cartridges may also be arranged in a state in which FIG. 8 is turned 180□ when they are viewed from the front and the installed part may also be constituted so that the cartridges 30 are installed or detached from the top of the printer body 10 shown in FIG. 1.

Sixth Embodiment

Figure 9:
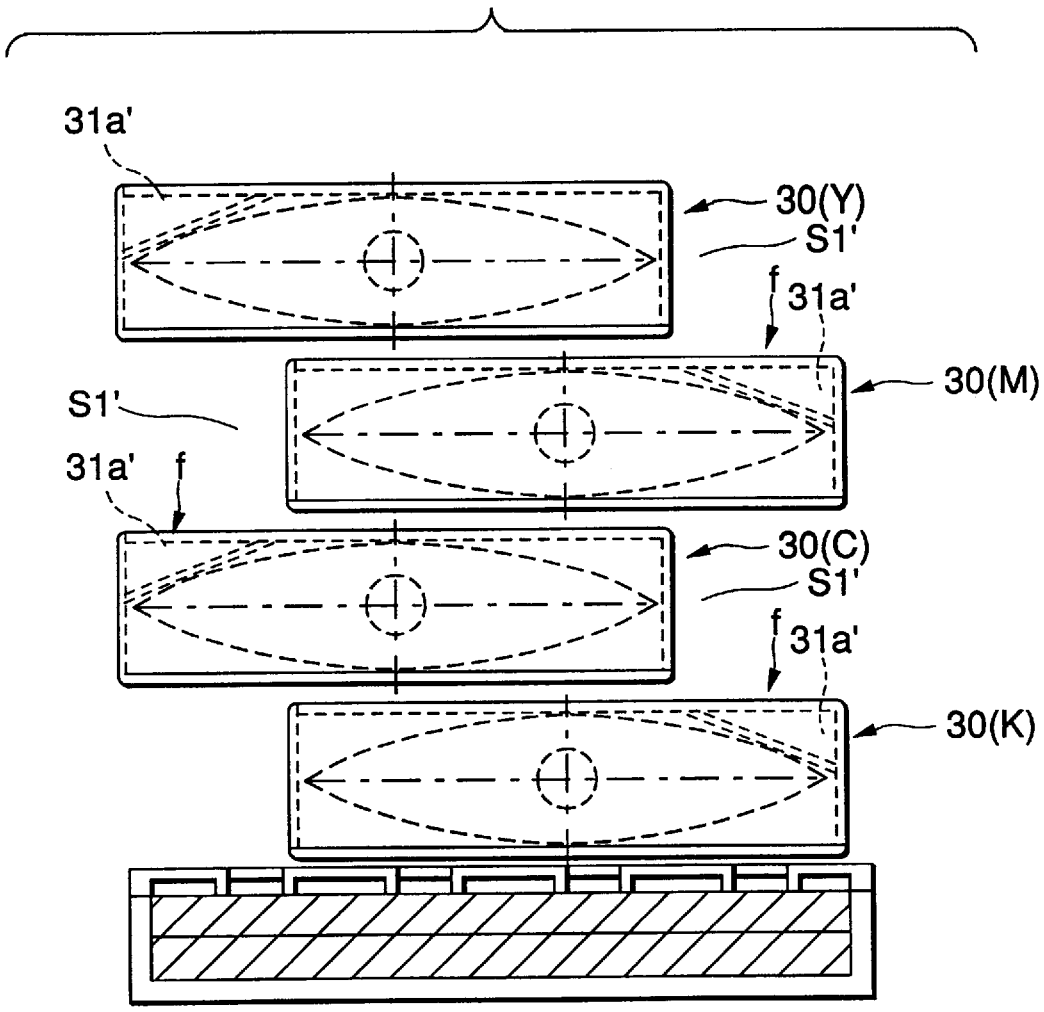
FIG. 9 is a front view showing the main part of a part in which cartridges are installed in a sixth embodiment of the ink-jet printer according to the present invention.

FIG. 9 is a front view showing the main part of a cartridge installed part in a sixth embodiment of the ink-jet printer according to the present invention. In FIG. 9, the same reference number is allocated to the same part or an equivalent part as to that in the above third embodiment.

This embodiment is different from the above third embodiment in that cartridges 30 (Y, M, C and K) laid crosswise are arranged not like a staircase but zigzag when they are viewed from the front. A finger grasping part 31*a*' is constituted as a concave portion (a groove, a section of which is a triangle) on the left upper surface or the right upper surface at the back of the cartridges 30 which is easily accessible as shown by an arrow f so that fingers can be easily placed in the finger grasping part 31*a*' utilizing space S1' formed above the finger grasping part 31*a*' by arranging each end with the finger grasping part 31*a*' of the cartridges 30 in a zigzag pattern.

According to such constitution, not only the length in a direction (in a vertical direction in FIG. 9) of an interval between the cartridges 30, that is, the height of the printer, but the length in a direction perpendicular to the direction of an interval between the cartridges (the length in a horizontal direction in FIG. 9) can be shortened.

The cartridges 30 may also be arranged in a staircase-like manner as shown in FIG. 9 when they are viewed from the right side and the installed part may also be constituted so that the cartridges 30 are installed or detached from the right side of the printer body 10 shown in FIG. 1. The cartridges may also be arranged in a state shown in FIG. 9 when they are viewed from the top and the installed part may also be constituted so that the cartridges 30 are installed or detached from the top of the printer body 10 shown in FIG. 1. Further, the cartridges may also be arranged in a state in which FIG. 9 is turned by 90□ clockwise when they are viewed from the top and the installed part may also be constituted so that the cartridges 30 are installed or detached from the top of the printer body 10 shown in FIG. 1.

Seventh Embodiment

Figure 10:
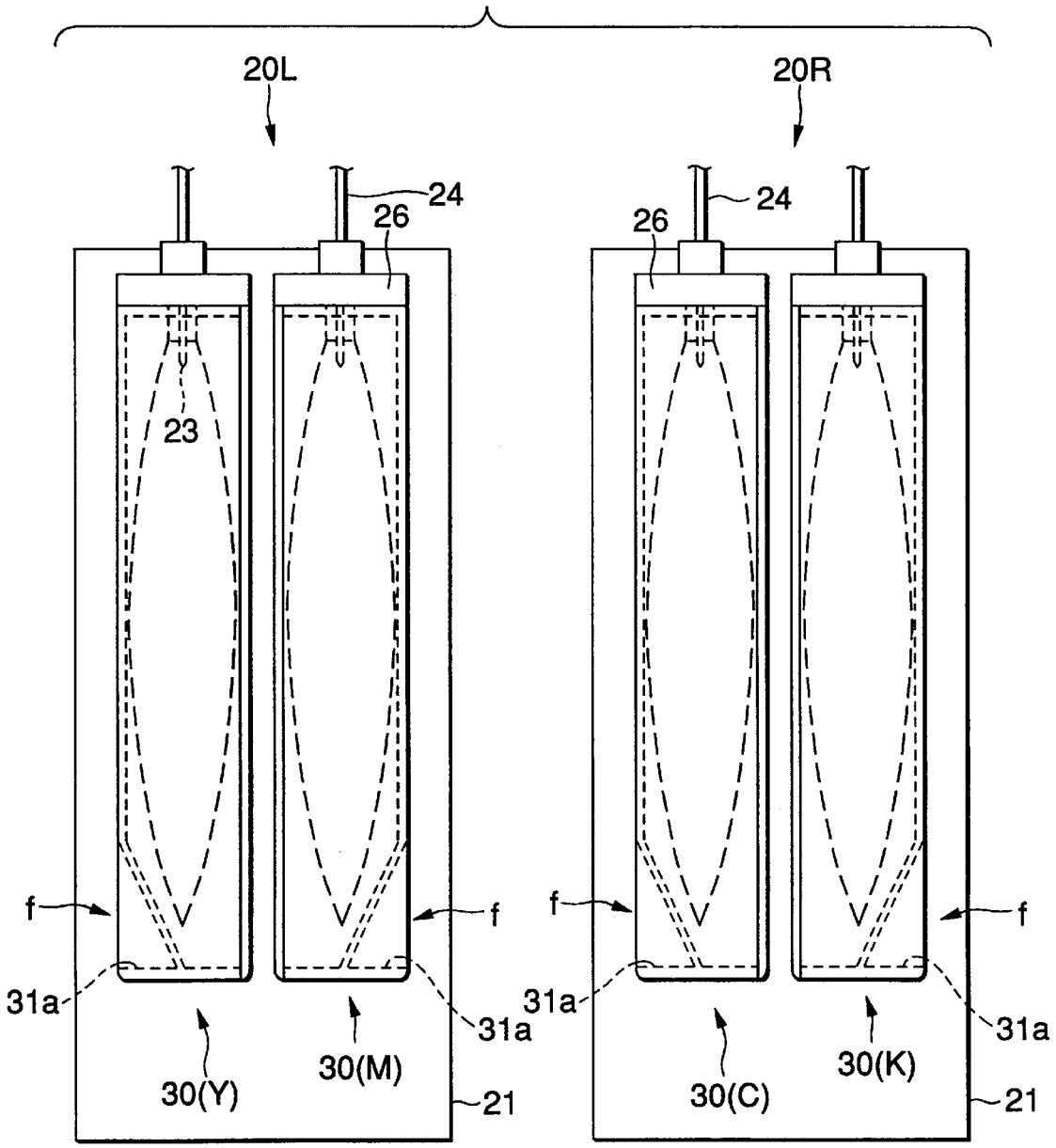
FIG. 10 is a plan view showing the main part of a part in which cartridges are installed in a seventh embodiment of the ink-jet printer according to the present invention.

FIG. 10 is a plan view showing the main part of a cartridge installed part in a seventh embodiment of the ink-jet printer according to the present invention. In FIG. 10, the same reference number is allocated to the same part or an equivalent part as to that in the above first embodiment.

In this embodiment, the installed part is separated in right and left parts (the separated installed part on the left side is shown as 20L and the installed part on the right side is shown as 20R) and two cartridges 30 are installed in each installed part 20L and 20R.

This embodiment is characterized in that each finger grasping part 31*a* shown by an arrow f of a pair of two cartridges (for example, 30Y and 30M) is formed on the side which is not opposed by an adjacent cartridge (outside in this case).

According to this embodiment, as each finger grasping part 31*a* of a pair of two cartridges is formed on the side which is not opposed by an adjacent cartridge, the cartridges 30 can be easily detached without increasing an interval between a pair of cartridges (for example, 30Y and 30M).

Therefore, an interval between the cartridges can be narrowed and as a result, the width of the printer can be narrowed.

According to this embodiment, as in the embodiment shown in FIG. 3, as the ink cartridges 30 can be arranged in a vacant space except a printing range such as the accelerating/decelerating area of the carriage 15, the width of the printer can be narrowed.

In addition, as one of a pair of two cartridges (for example, 30Y and 30M) is required to be shifted in the longitudinal direction (in a vertical direction in FIG. 3) in the embodiment shown in FIG. 3, each length in the longitudinal direction of the installed parts 20L and 20R is required to be extended. However, according to the seventh embodiment, as one of a pair of two cartridges (for example, 30Y and 30M) is not required to be shifted in the longitudinal direction (in a vertical direction in FIG. 10), the length in the longitudinal direction of the installed parts 20L and 20R, that is, the length of the cartridges 30 in a direction in which they are installed or detached, can be shortened by the quantity.

The cartridges 30 may also be arranged in a state in which FIG. 10 is turned by 90□ counterclockwise when they are viewed from the front and the installed part may also be constituted so that the cartridges 30 are installed or detached from the right side of the printer body 10 shown in FIG. 1. The cartridges 30 may also be arranged in a state in which FIG. 10 is turned by 90□ counterclockwise when they are viewed from the left side and the installed part may also be constituted so that the cartridges 30 are installed or detached from the front of the printer body 10 shown in FIG. 1. Further, the cartridges may also be arranged in a state in which FIG. 10 is turned 180° when they are viewed from the right side and the installed part may also be constituted so that the cartridges 30 are installed or detached from the top of the printer body 10 shown in FIG. 1. Furthermore, the cartridges may also be arranged in a state in which FIG. 10 is turned 180□ when they are viewed from the front and the installed part may also be constituted so that the cartridges 30 are installed or detached from the top of the printer body 10 shown in FIG. 1.

Eighth Embodiment

Figure 11:
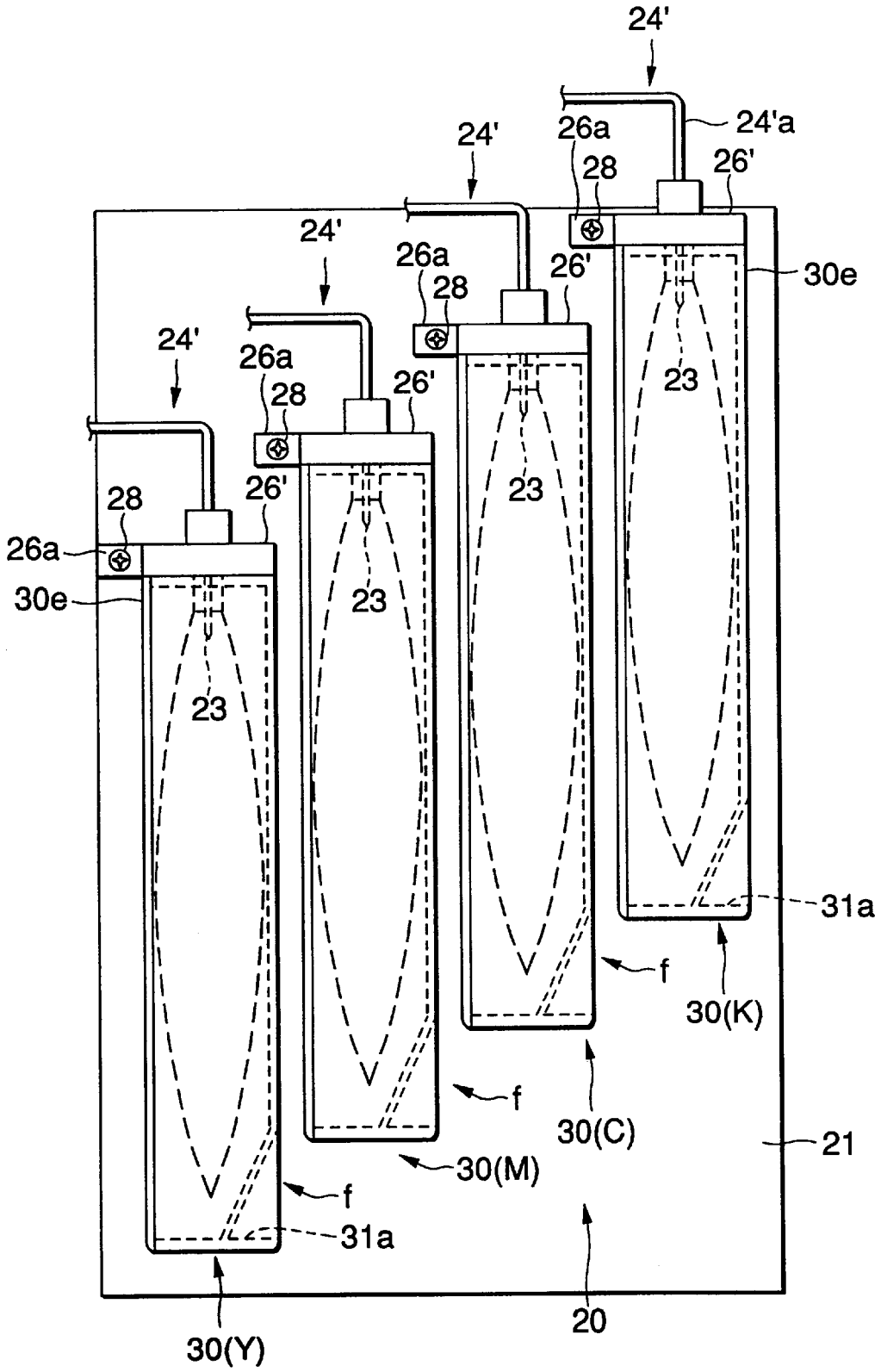
FIG. 11 is a plan view-showing the main part of a part in which cartridges are installed in an eighth embodiment of the ink-jet printer according to the present invention.

FIG. 11 is a plan view showing the main part of a cartridge installed part in an eighth embodiment of the ink-jet printer according to the present invention. In FIG. 11, the same reference number is allocated to the same part or an equivalent part as to that in the above first embodiment.

This embodiment is characterized in that each end 30*e* on the installed side of ink cartridges 30 (Y, M, C and K) is arranged in a staircase-like manner with the ink cartridges installed in the installed part 20, a fixing part 26*a* is integrated with a standing wall 26 which is a member for attaching an ink supply needle 23 at the lower end of the standing wall 26, the standing wall 26 is fixed to the bottom plate 21 of the installed part by a screw 28 using the fixing part 26*a*, and an L-type metallic tube 24' is used for an ink tube.

Figure 23A:
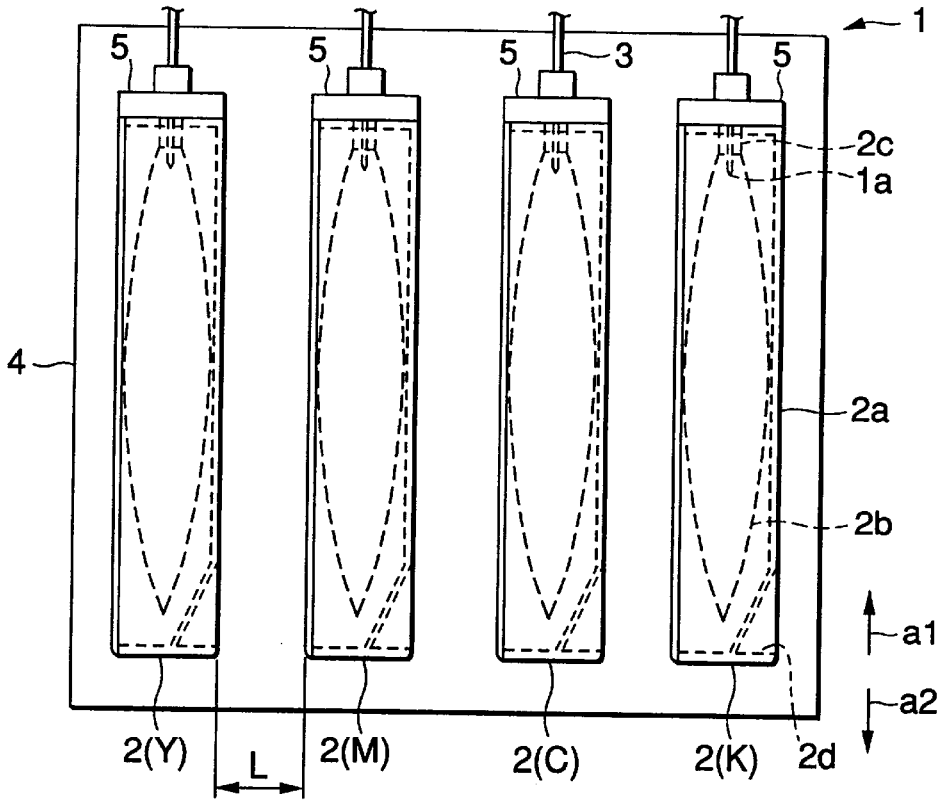
FIG. 23(*a*), FIG. 23(*b*), FIG. 24(*a*) and FIG. 24(*b*) are explanatory drawings showing related art.
Figure 23B:
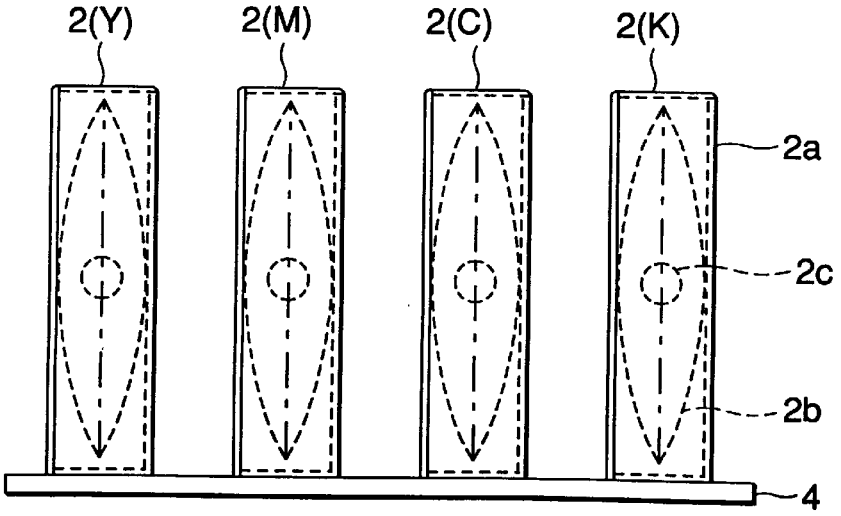

If this type of structure was used in the ink-jet printer shown in FIG. 23 where plural ink cartridges 30 are only arranged in parallel, the interval L between the cartridges is increased to prevent interference between the fixing parts. Further, if the L-type metallic tube 24' is utilized, different types of tubes (tubes different in the length of a part 24'*a* extended in the same direction as the ink supply needle 23 in FIG. 11) are required to be used.

On the other hand, according to this embodiment, since each end 30*e* on the installed side of the ink cartridges 30 (Y, M, C and K) is arranged like a staircase with the ink cartridges installed in the installed part 20, the fixing parts 26*a* do not interfere with each other. Therefore, an interval between the cartridges 30 can be narrowed.

Even if the L-type metallic tube 24' is used, the tubes 24' do not interfere with each other and therefore, tubes of different types are not required to be used. That is, the L-type metallic tube 24' can be shared.

Ninth Embodiment

Figure 12A:
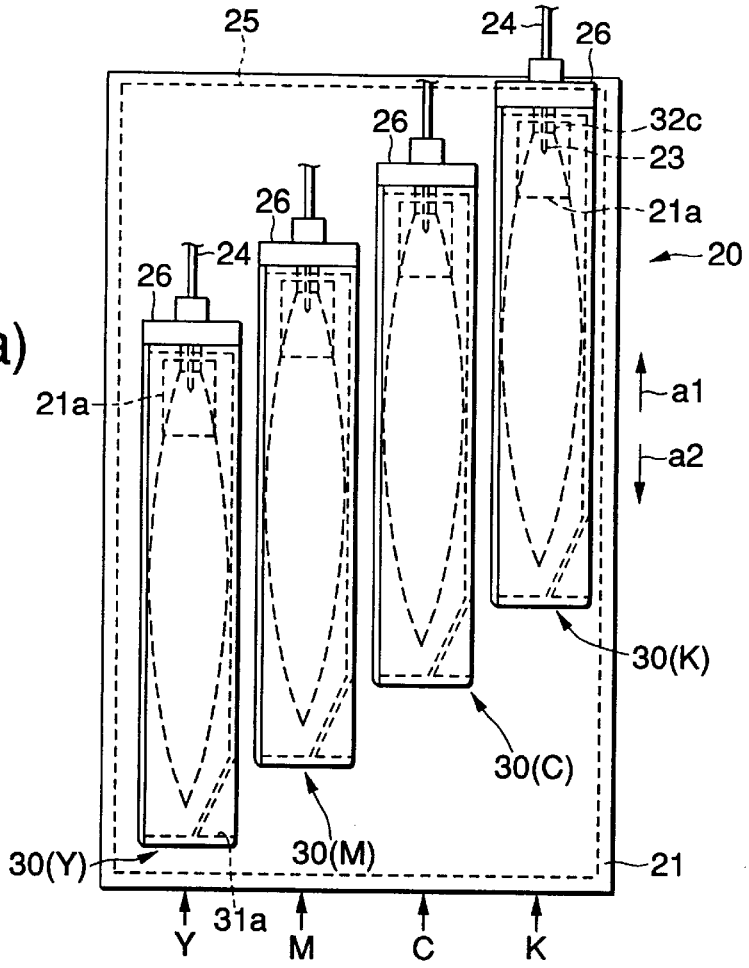
FIGS. 12(*a*) and (*b*) show the main part of a part in which ink cartridges are installed in a ninth embodiment of the ink-jet printer according to the present invention, where FIG. 12(*a*) is a plan view and FIG. 12(*b*) is a front view.
Figure 12B:
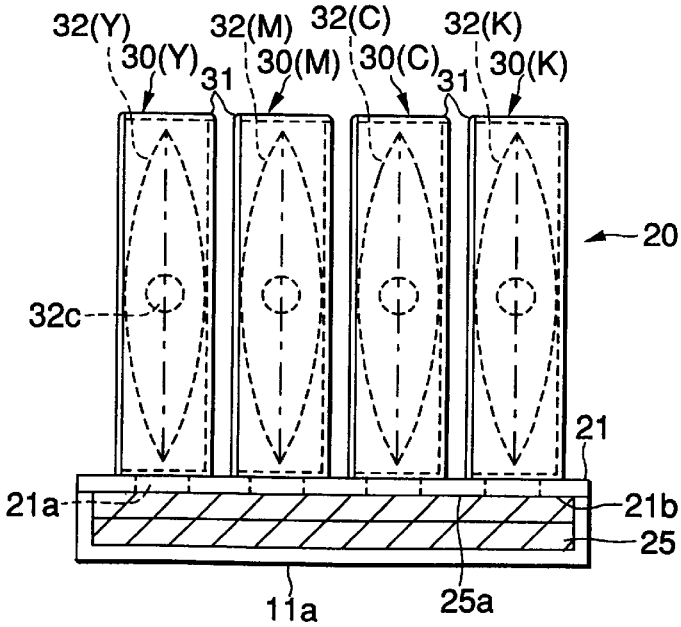

FIGS. 12(*a*) and (*b*) are schematic drawings showing ink cartridges installed part in a ninth embodiment of the ink-jet printer according to the present invention, where FIG. 12 (*a*) is a plan view and FIG. 12(*b*) is a front view. In FIGS. 12(*a*) and (*b*), the same reference number is allocated to the same part or an equivalent part as to that in the above first embodiment.

In this embodiment, a waste ink absorber 25, for absorbing ink sucked by a pump via a nozzle when the nozzle of an ink jet head is clogged and forcedly discharged outside the head, is arranged under the installed part 20.

The waste ink absorber 25 is arranged between the bottom plate 11*a* of the lower case 11 of the printer body 10 and the bottom plate 21 of the installed part 20 in such a manner that the waste ink absorber is located under all ink supply needles 23 arranged in a staircase-like manner as viewed from the top as shown in FIG. 12(*a*).

An opening 21*a,* which functions as a drain opening for ink, is provided in the bottom plate 21 of the installed part 20 under each ink supply needle 23. Therefore, even if ink drops from the ink supply needle 23 when the cartridges 30 are installed or detached, the ink is dropped on the waste ink absorber 25 via the opening 21*a* and absorbed.

The upper surface 25*a* of the waste ink absorber 25 in this embodiment is in contact with the lower surface 21*b* of the bottom plate 21 of the installed part 20. Therefore, even if ink drops in a location displaced from the opening 21*a* from the ink supply needle 23, it is securely and promptly absorbed in the waste ink absorber 25 through the opening 21*a.*

Figure 24A:
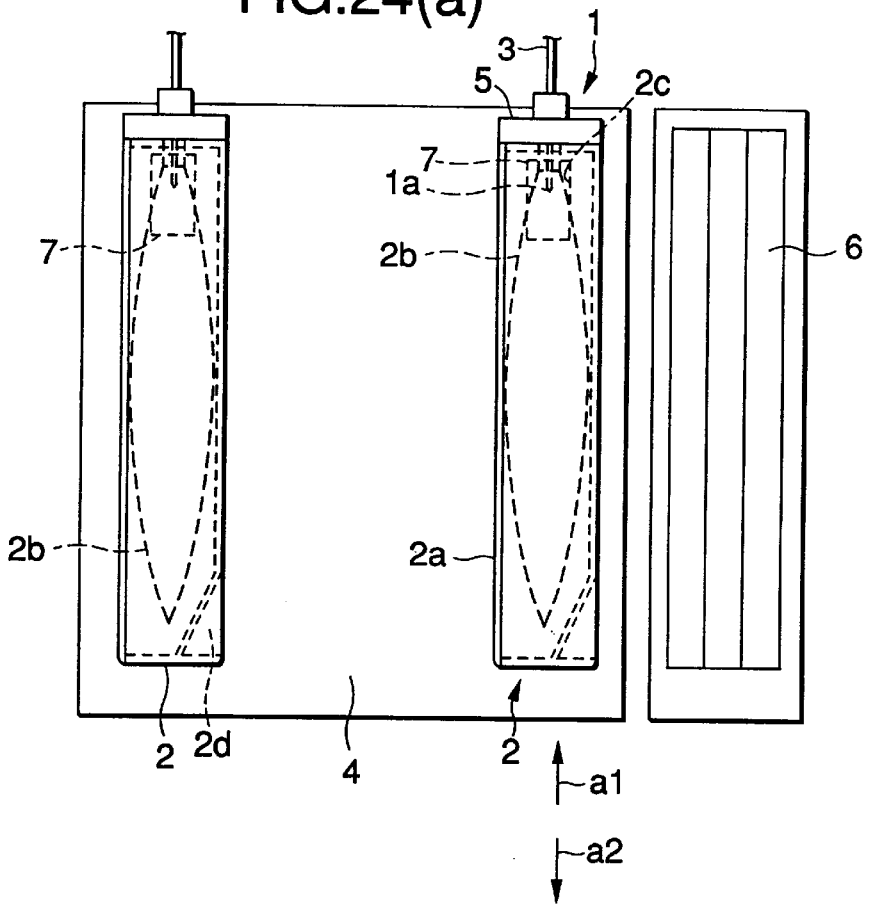
Figure 24B:
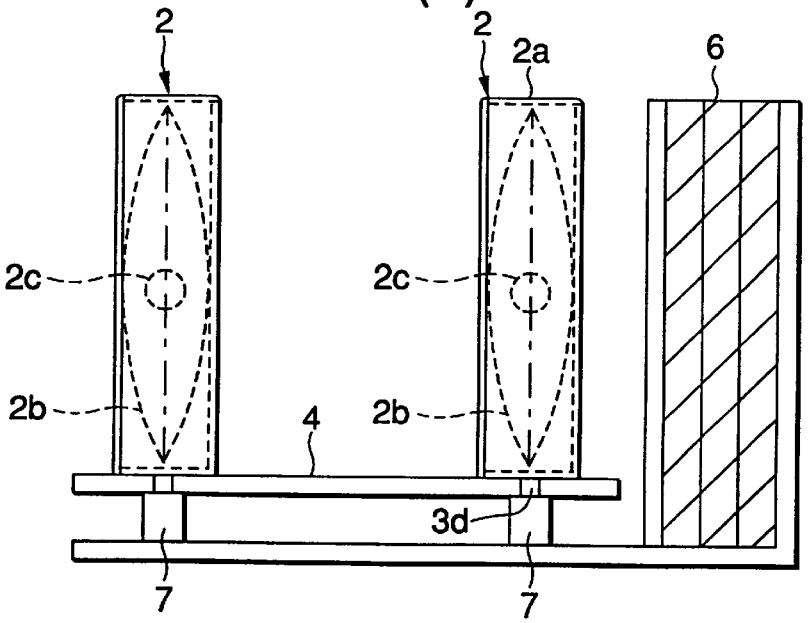

According to such an ink-jet printer, the following action and effect can be obtained:

(a) As the waste ink absorber 25 is arranged in a position in which ink dropped from the ink supply needle 23 can be absorbed under the part 20 in which the ink cartridges 30 are installed, the ink absorber 7, different from the waste ink absorber required in the printer shown in FIG. 24, is not required to be arranged under the ink supply needle.

(b) Also, simultaneously, as the waste ink absorber 25 is arranged under the ink cartridges installed part 20, the width of the printer can be narrowed. That is, according to the ink-jet printer in this embodiment, the number of parts can be reduced and the width can be narrowed.

(c) As the upper surface 25*a* of the waste ink absorber 25 is in contact with the lower surface 21*b* of the bottom plate 21 of the installed part 20, ink is securely and promptly absorbed in the waste ink absorber 25 through the faucet 21*a.*

Tenth Embodiment

Figure 13:
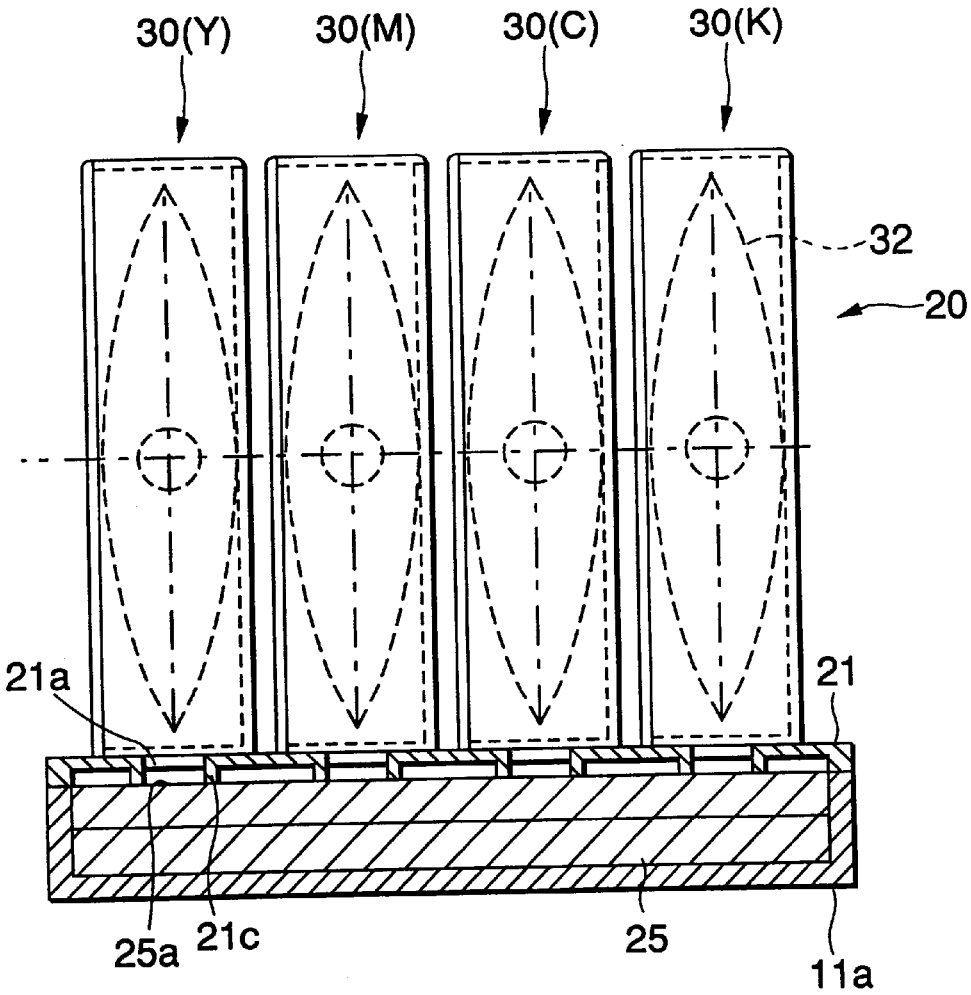
FIG. 13 is a partial sectional front view showing the main part of a part in which cartridges are installed in a tenth embodiment of the ink-jet printer according to the present invention.

FIG. 13 is a partial sectional front view showing the main part of a cartridge installed part in a tenth embodiment of the ink-jet printer according to the present invention. In FIG. 13, the same reference number is allocated to the same part or an equivalent part as to that in the above ninth embodiment.

This embodiment is different from the above ninth embodiment in that the lower part 21*c* of the edge of a opening 21*a* is in contact with the upper surface 25*a* of a waste ink absorber 25 but is the same as the ninth embodiment in the other points.

According to such constitution, as the lower part 21*c* of the edge of the opening 21*a* is in contact with the upper surface 25*a* of the waste ink absorber 25, ink is securely and promptly absorbed in the waste ink absorber 25 through the opening 21*a.*

Eleventh Embodiment

Figure 14A:
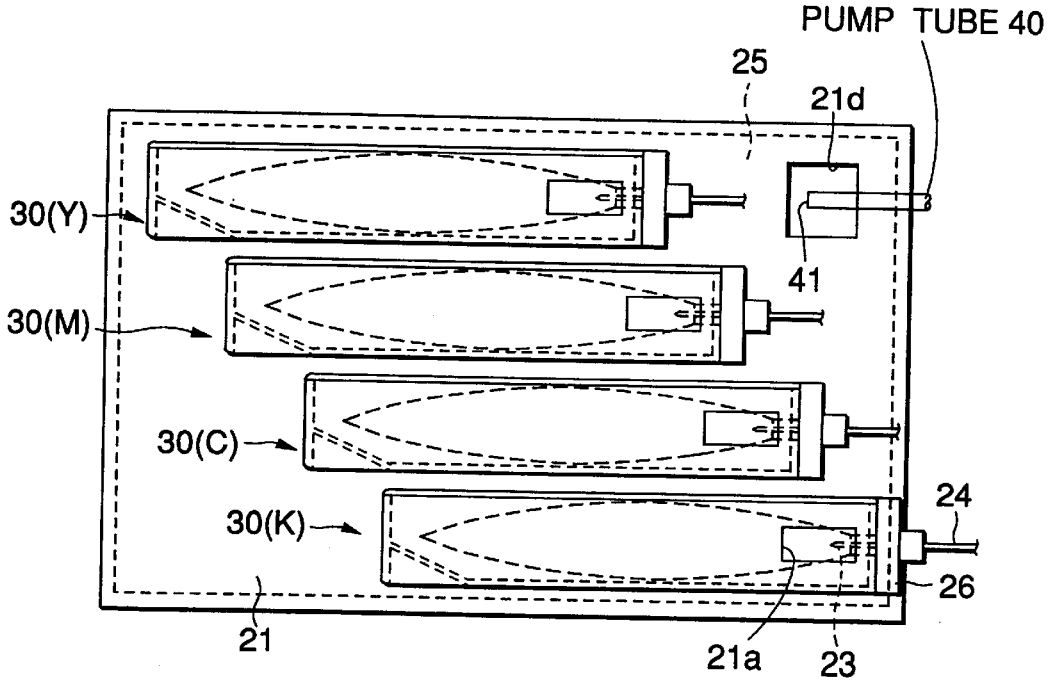
FIGS. 14(*a*) and (*b*) show the main part of a part in which cartridges are installed in an eleventh embodiment of the ink-jet printer according to the present invention, where FIG. 14(*a*) is a plan view at a different angle from that in FIG. 12(*a*) and FIG. 14(*b*) is a partial sectional front view in which cartridges 30 shown in FIG. 14(*a*) are omitted.
Figure 14B:
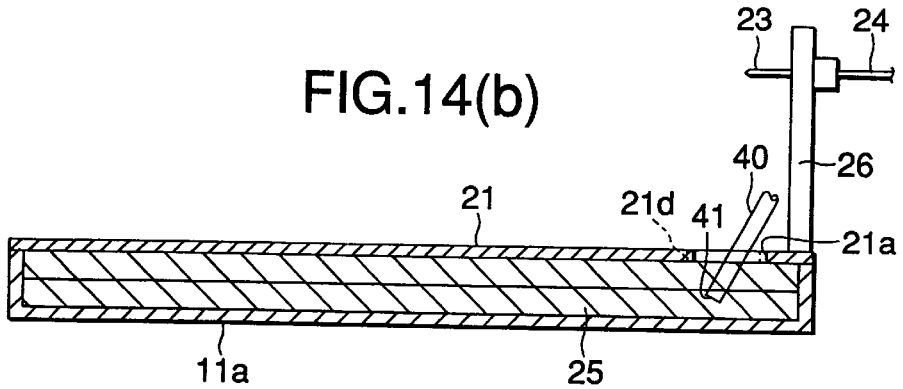

FIGS. 14(*a*) and (*b*) show the main part of a cartridge installed part in an eleventh embodiment of the ink-jet printer according to the present invention, where FIG. 14(*a*) is a plan view at a different angle from the angle in FIG. 12(*a*) and FIG. 14(*b*) is a partial sectional front view in which cartridges 30 shown in FIG. 14(*a*) are omitted. In FIGS. 14(*a*) and (*b*), the same reference number is allocated to the same part or an equivalent part as to that in the above ninth embodiment.

As shown in FIG. 14, this embodiment is characterized in that the end (the exhaust port) 41 of a waste ink tube 40 for discharging ink sucked by a pump from a head (not shown) outside the pump is arranged under a waste ink absorber 25, waste ink from the head is absorbed in the waste ink absorber 25 from under the waste ink absorber 25 and ink dropped from an ink supply needle 23 is absorbed in the waste ink absorber 25 from over the waste ink absorber 25 through an opening 21*a*. Reference number 21*d* denotes an opening for inserting the waste ink tube 40.

As described above, if ink dropped from the ink supply needle 23 and ink discharged outside the head through a nozzle of the ink jet head are absorbed in the waste ink absorber 25 which is a common ink absorber, it is desirable that the waste ink absorber 25 be prevented from being locally saturated and ink from the ink supply needle 23 and ink from the ink jet head are effectively absorbed in the waste ink absorber 25.

In the meantime, according to the ink-jet printer in the eleventh embodiment, ink dropped from the ink supply needle 23 and ink discharged from the nozzle of the ink jet head outside the head are absorbed in the waste ink absorber 25 from the separate sides (the upper and lower sides) in the waste ink absorber 25. Thus, a local saturated state is prevented and both ink is effectively absorbed in the waste ink absorber 25.

Twelfth Embodiment

Figure 15A:
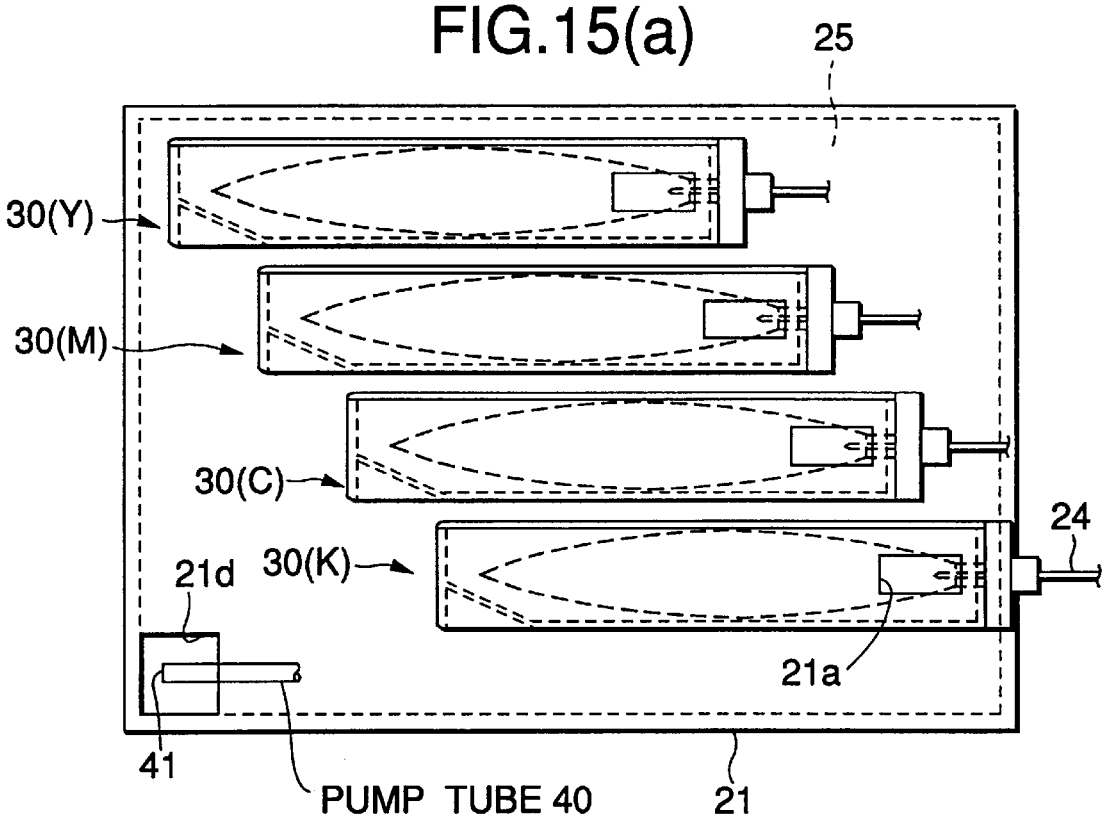
FIGS. 15(*a*) and (*b*) show the main part of a part in which cartridges are installed in a twelfth embodiment of the ink-jet printer according to the present invention, where FIG. 15(*a*) is a plan view at a different angle from that in FIG. 12(*a*) and FIG. 15(*b*) is a partial sectional front view in which cartridges 30 shown in FIG. 15(*a*) are omitted.
Figure 15B:
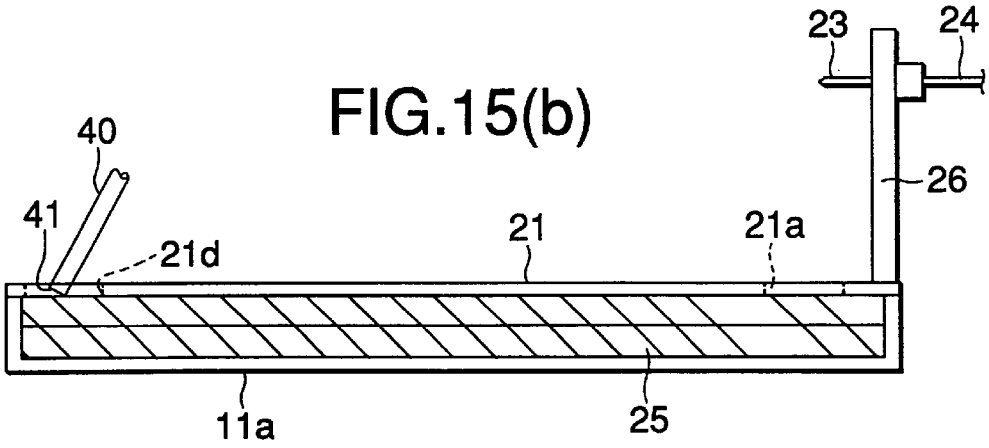

FIGS. 15(*a*) and (*b*) show the main part of a cartridge installed part in a twelfth embodiment of the ink-jet printer according to the present invention, where FIG. 15(*a*) is a plan viewed at a different angle from the angle in FIG. 12(*a*) and FIG. 15(*b*) is a partial sectional front view in which cartridges 30 shown in FIG. 15(*a*) are omitted. In FIGs. 15, the same reference number is allocated to the same part or an equivalent part as to that in the above eleventh embodiment.

As shown in FIGS. 15(*a*) and (*b*), this embodiment is characterized in that the end 41 of a waste ink tube 40 is arranged on the rear side of a waste ink absorber, waste ink from a head is absorbed in a waste ink absorber 25 from the rear side of the waste ink absorber 25 and ink dropped from an ink supply needle 23 is absorbed in the waste ink absorber 25 through a drain opening 21*a* from the front side of the waste ink absorber 25.

As ink dropped from the ink supply needle 23 and ink discharged from the nozzle of the ink jet head outside the head are also absorbed in the waste ink absorber 25 from the separate sides (the front and rear sides) of the waste ink absorber 25 in such constitution, a local saturated state is prevented and both ink is effectively absorbed in the waste ink absorber 25.

It is preferable that the end 41 of the waste ink tube 40 is arranged under the waste ink absorber as shown in FIG. 15(*b*).

Thirteenth Embodiment

Figure 16:
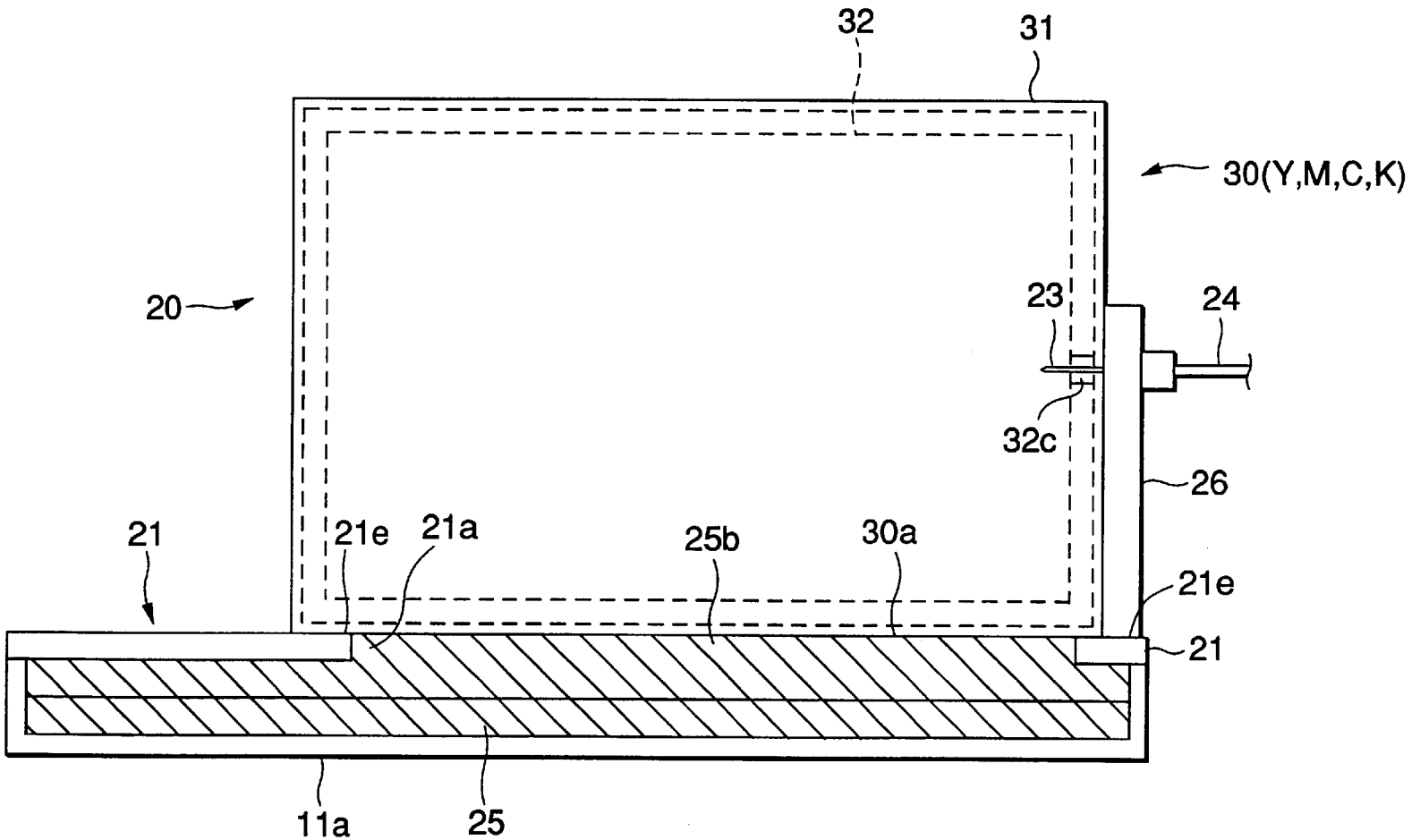
FIG. 16 is a partial sectional side view showing the main part of a part in which cartridges are part in a thirteenth embodiment of the ink-jet printer according to the present invention.

FIG. 16 is a partial sectional side view showing the main part of a cartridge installed part in a thirteenth embodiment of the ink-jet printer according to the present invention. In FIG. 16, the same reference number is allocated to the same part or an equivalent part as to that in the above ninth embodiment.

This embodiment is characterized in that the opening 21*a* of ink is formed so that it is longer in a direction in which the cartridges 30 are installed or detached (in a horizontal direction in FIG. 16). Further, a waste ink absorber is constituted so that a part 25*b* of the waste ink absorber 25 reaches the same plane as the upper surface 21*e* of the bottom plate 21 of the installed part through the opening 21*a* and is pressed upon the bottom face 30*a* of an ink cartridge 30 installed in the installed part 20. It is desirable that the width of the opening 21*a* (the length in a direction perpendicular to the surface of paper in FIG. 16) is wider than that of an ink cartridge 30.

According to such constitution, as the opening 21*a* is formed so that it is long, ink dropped from an ink supply needle 23 is securely received by the faucet 21*a*.

As a part 25*b* of the waste ink absorber 25 extends to the same plane as the upper surface 21*e* of the bottom plate 21 through the faucet 21*a*, the bottom face 30*a* of the cartridges 30 extracted from the installed part 20 is rubbed by the above part 25*b* of the waste ink absorber 25.

Therefore, as ink is wiped by the above part 25*b* of the waste ink absorber even if the ink adheres to the bottom face 30*a* of the cartridges 30, the bottom face 30*a* of the cartridges 30 is hardly contaminated. As the overall width of the bottom face 30*a* of the cartridges 30 is wiped, that is, the width of the above part 25*b* of the waste ink absorber is constituted so that it is wider than the width of the ink cartridges 30, the bottom face 30*a* of the cartridges 30 is less likely to be contaminated.

In addition, as the bottom face 30*a* of the cartridges 30 is wiped by the above part 25*b* of the waste ink absorber 25, a member for wiping the bottom face of the cartridges 30 is not required to be provided separately.

Further, as the above part 25*b* of the waste ink absorber 25 is pressed on the bottom face 30*a* of the ink cartridges 30 installed in the installed part 20, the bottom face 30*a* of the cartridges 30 is more satisfactorily wiped.

Fourteenth Embodiment

Figure 17:
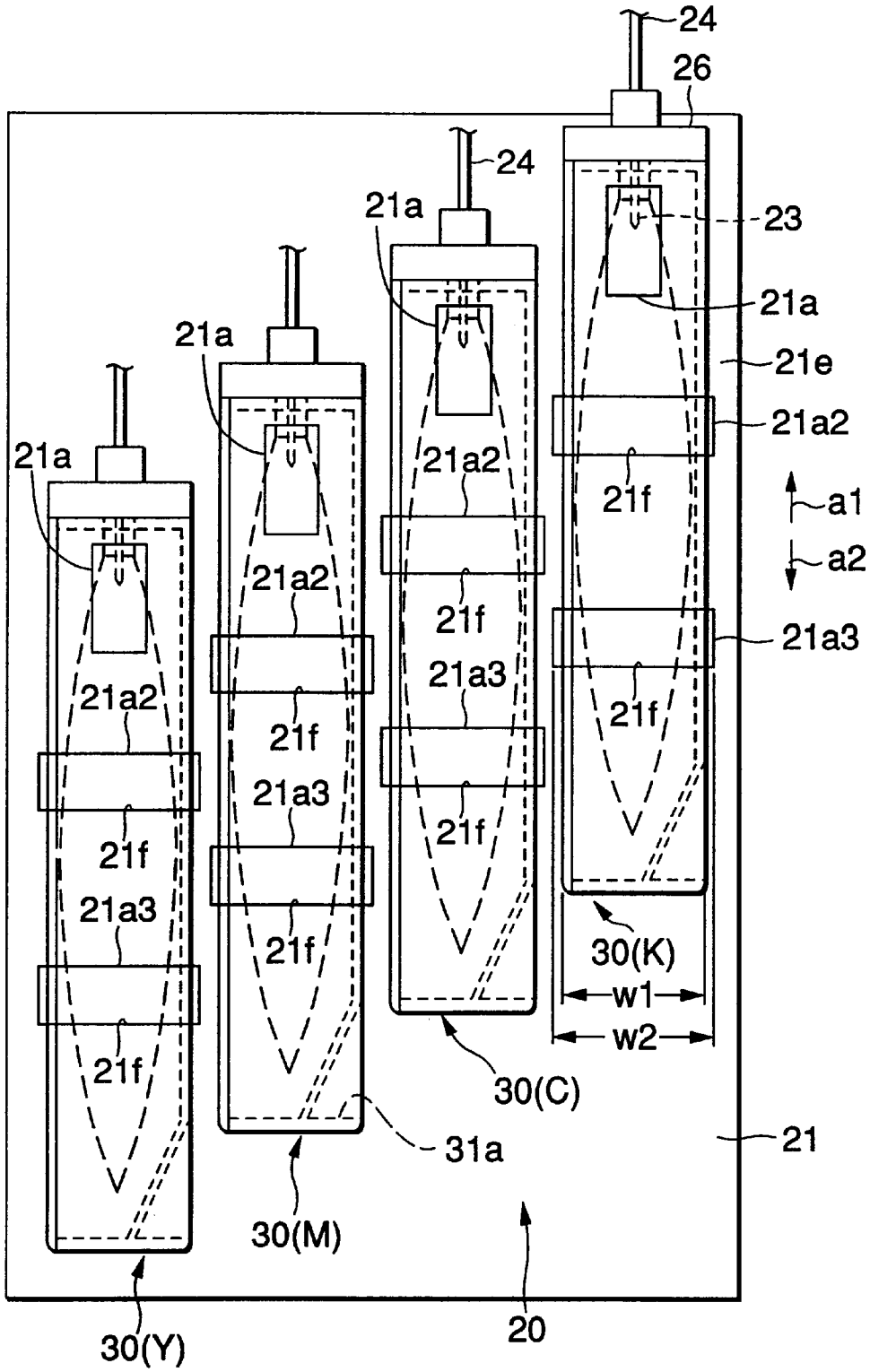
FIG. 17 is a plan view showing the main part of a part in which cartridges are installed in a fourteenth embodiment of the ink-jet printer according to the present invention.

FIG. 17 is a plan showing the main part of a cartridge installed part in a fourteenth embodiment of the ink-jet printer according to the present invention. In FIG. 17, the same reference number is allocated to the same part or an equivalent part as to that in the above ninth embodiment.

This embodiment is characterized in that a total of three openings for ink 21*a*, 21*a*2 and 21*a*3 are provided in a direction in which an ink cartridge 30 is installed or detached and each width W2 of the drain openings 21*a*2 and 21*a*3 of these plural drain openings is formed so that it is wider than the width W1 of the ink cartridges 30.

In this embodiment, as in the above thirteenth embodiment, a part 25*b* of a waste ink absorber 25 can also be constituted so that it reaches the same plane as the upper surface 21*e* of the bottom plate 21 of the installed part via the drain openings 21*a*, 21*a*2 and 21*a*3 and the above part 25*b* can also be constituted so that it is pressed on the bottom face 30*a* of the ink cartridges 30 installed in the installed part 20.

According to the above constitution, as plural opening for ink are provided in a direction in which the ink cartridges are installed or detached, ink dropped from an ink supply needle 23 can drain through. For example, opening 21*a*2 through the upper surface 21*e* of the bottom plate even if the above ink does not drain into opening 21*a* so the bottom of the cartridges 30 is prevented from being extremely contaminated by ink.

In addition, even if ink adheres to the bottom face of the cartridges 30, the bottom face of the cartridges 30 extracted in a direction shown by an arrow *a*2 from the installed part 20 is wiped by the edge 21*f* of plural openings, particularly the openings 21*a*2 and 21*a*3, the bottom face of the cartridges 30 is prevented from being extremely contaminated.

As the bottom face of the cartridges 30 is also wiped by a part 25*b* of the waste ink absorber 25 in case the above part 25*b* of the waste ink absorber 25 is constituted so that it reaches the same plane as the upper surface 21*e* of the bottom plate 21 through the faucet, the bottom face of the cartridges 30 is securely prevented from being extremely contaminated.

Further, as each width W2 of the two openings 21*a*2 and 21*a*3 of plural drain openings is formed so that it is wider than the width W1 of the ink cartridges 30, the overall width W1 of the bottom face of the cartridges 30 extracted from the installed part 20 is wiped by the edge 21*f* of each opening even if ink adheres to the bottom face of the cartridges 30 and the bottom face of the cartridges 30 is more securely prevented from being extremely contaminated.

As the overall width W1 of the bottom face of the cartridges 30 is also wiped by a part 25*b* of the waste ink absorber 25 in case the above part 25*b* of the waste ink absorber 25 is constituted so that it reaches the same plane as the upper surface 21*e* of the bottom plate 21 through the faucet, the bottom face of the cartridges 30 is more securely prevented from being extremely contaminated.

Fifteenth Embodiment

Figure 18:
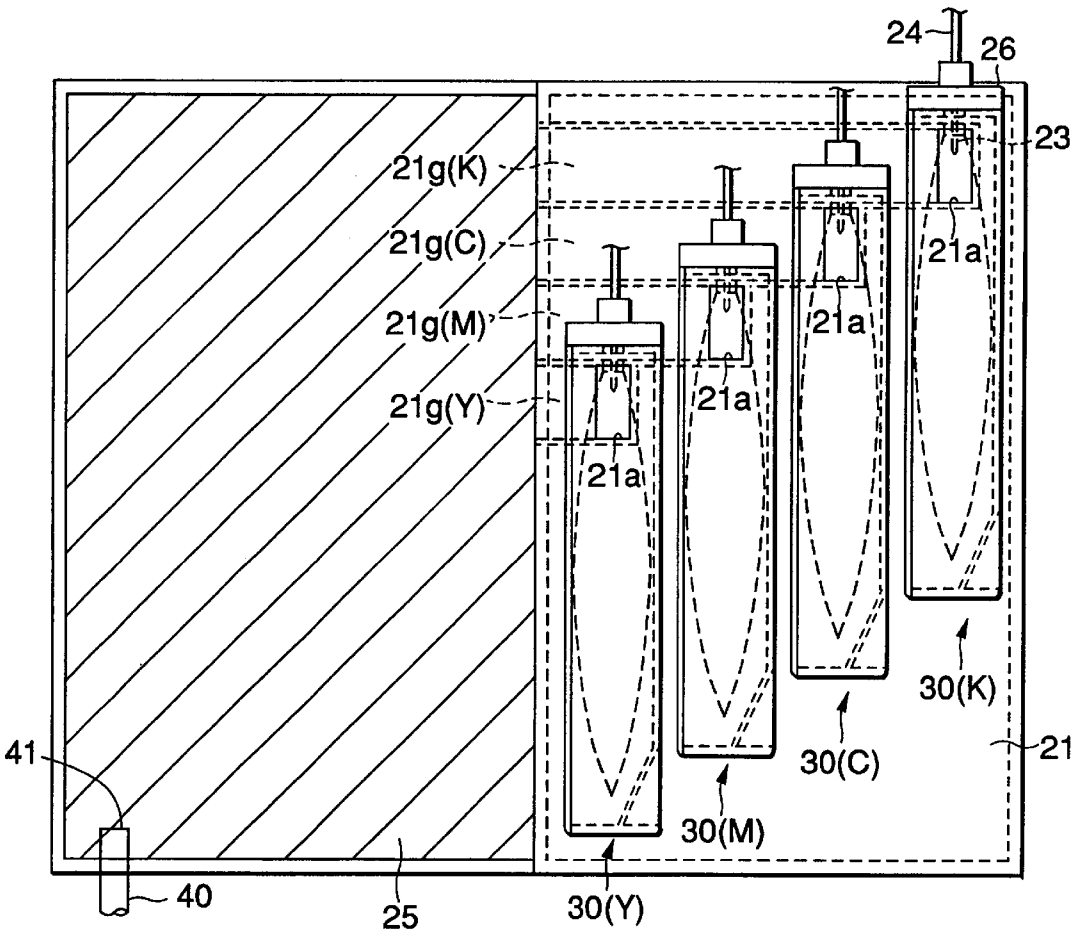
FIG. 18 is a plan view showing the main part of a part in which cartridges are installed in a fifteenth embodiment of the ink-jet printer according to the present invention.
Figure 19:
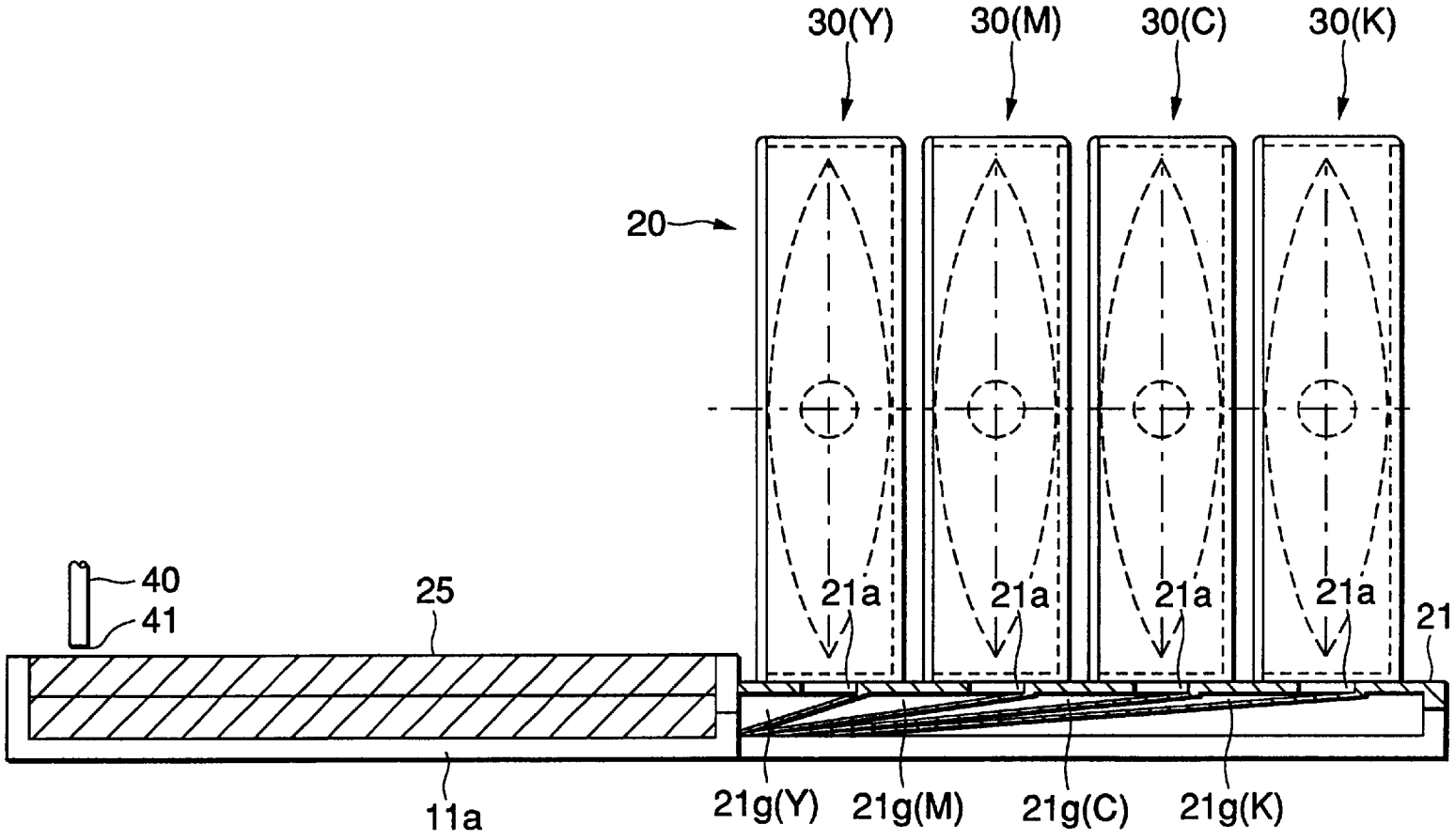
FIG. 19 is a partial sectional front view showing the main part of the part in which cartridges are installed in the fifteenth embodiment of the ink-jet printer according to the present invention.

FIG. 18 is a plan view showing the main part of a cartridge installed part in a fifteenth embodiment of the ink-jet printer according to the present invention and FIG. 19 is the partial sectional front view. In FIGS. 18 and 19, the same reference number is allocated to the same part or an equivalent part as to that in the above ninth embodiment.

This embodiment is characterized in that ink passages 21*g* (Y, M, C and K) for leading ink from each opening 21*a* for ink to a waste ink absorber 25 are provided. The ink passage 21*g* in this embodiment is integrated with the bottom plate 21 of the installed part, however, the ink passage can also be integrated with the bottom plate 11*a* of the printer body.

According to this embodiment, as the ink passage 21*g* for leading ink from the opening 21*a* to the waste ink absorber 25 is provided, the degree of the freedom of positional relationship between the cartridges installed part 20 and the waste ink absorber 25 can be enhanced.

In this embodiment, the waste ink absorber 25 is arranged not under the cartridges installed part 20 but on the side.

In this case, as ink dropped from an ink supply needle 23 is absorbed in the waste ink absorber 25 from the right side of the waste ink absorber 25 through the opening 21*a* and the ink passage 21*g*, it is desirable that the end 41 of a waste ink tube 40 be arranged on the left side of the waste ink absorber 25.

In this embodiment, as shown in FIG. 17, plural openings can also be provided in a direction in which the ink cartridges are installed or detached and the width W2 of at least one opening can be formed so that it is wider than the width W1 of the ink cartridge. In these cases, the similar action and effect to the above ones are obtained.

Sixteenth Embodiment

Figure 20:
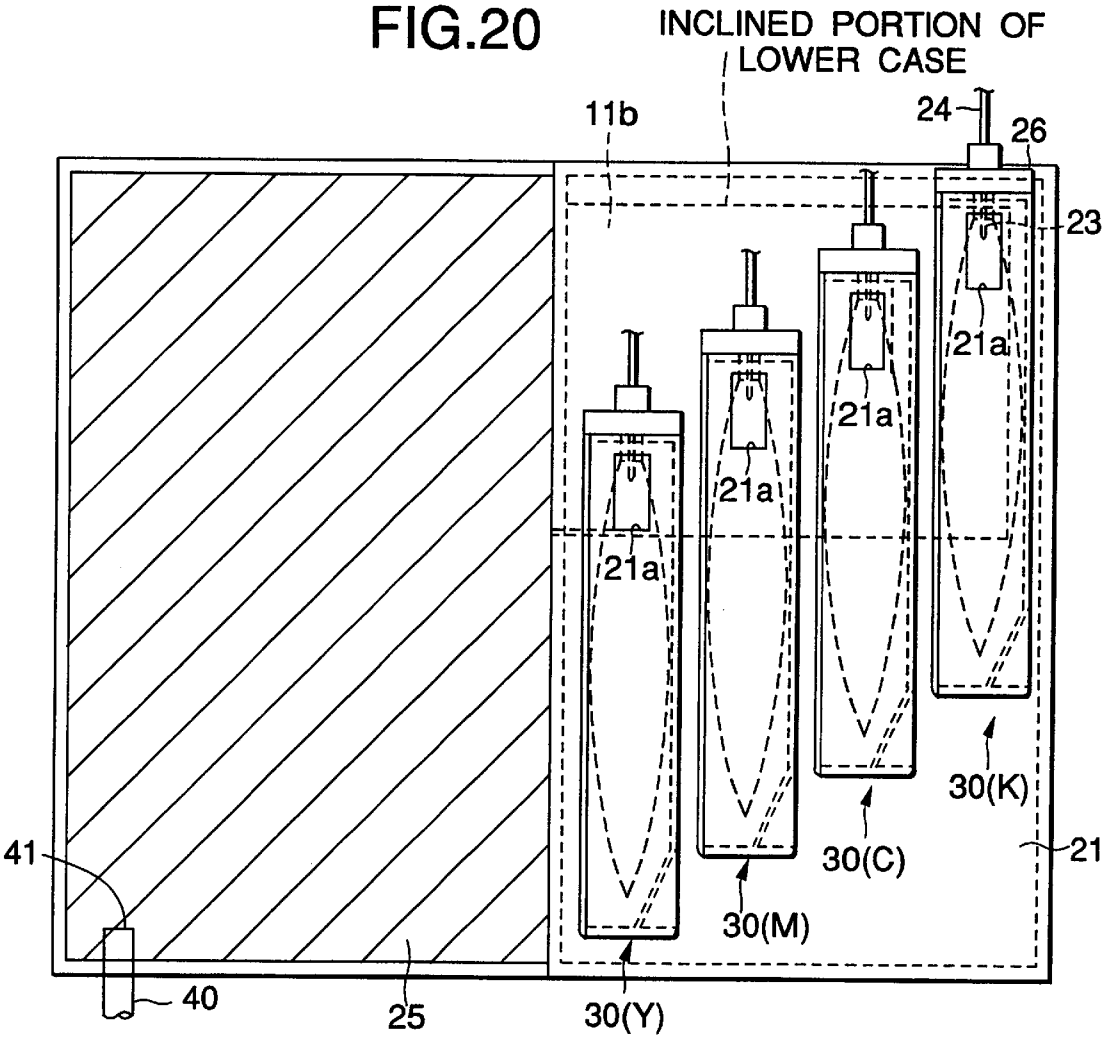
FIG. 20 is a plan view showing the main part of a part in which cartridges are installed in a sixteenth embodiment of the ink-jet printer according to the present invention.
Figure 21:
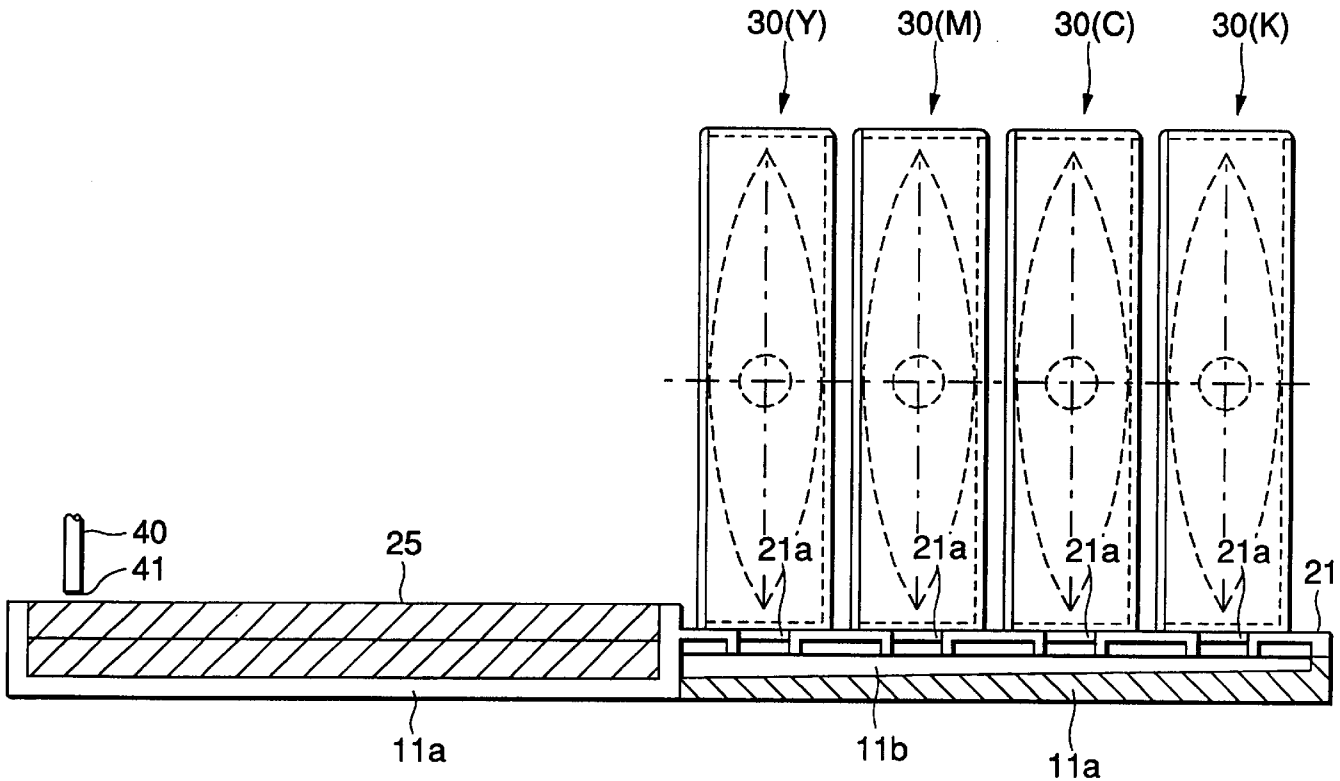
FIG. 21 is a partial sectional front view showing the main part of the part in which cartridges are installed in the sixteenth embodiment of the ink-jet printer according to the present invention.

FIG. 20 is a plan view showing the main part of a cartridge installed part in a sixteenth embodiment of the ink-jet printer according to the present invention and FIG. 21 is the partial sectional front view. In FIGS. 20 and 21, the same reference number is allocated to the same part or an equivalent part as to that in the above fifteenth embodiment.

This embodiment is different from the above fifteenth embodiment in that one wide ink passage lib for leading ink from four drain openings 21*a* to a waste ink absorber 25 is provided in place of the ink passages 21*g* but is the same as the fifteenth embodiment in the other points. The ink passage 11*b* in this embodiment is integrated with the bottom plate 11*a* of the body, however, the ink passage may also be integrated with the bottom plate 21 of the installed part 20.

According to this embodiment, as the ink passage 11*b* for leading ink from the drain openings 21*a* to the waste ink absorber 25 is also provided, the degree of the freedom of positional relationship between the cartridges installed part 20 and the waste ink absorber 25 can be enhanced.

In this embodiment, the waste ink absorber 25 is also arranged not under the cartridges installed part 20 but on the side. As ink dropped from an ink supply needle 23 is absorbed in the waste ink absorber 25 from the right side of the waste ink absorber 25 through the faucet 21*a* and the ink passage 11*b*, it is desirable that the end 41 of a waste ink tube 40 be arranged on the left side of the waste ink absorber 25.

In this embodiment, as shown in FIG. 17, plural drain openings can also be provided in a direction in which the ink cartridges are installed or detached and the width W2 of at least one faucet can also be formed so that it is wider than the width W1 of the ink cartridge. In these cases, the similar action and effect to the above ones are obtained.

Seventeenth Embodiment

Figure 22:
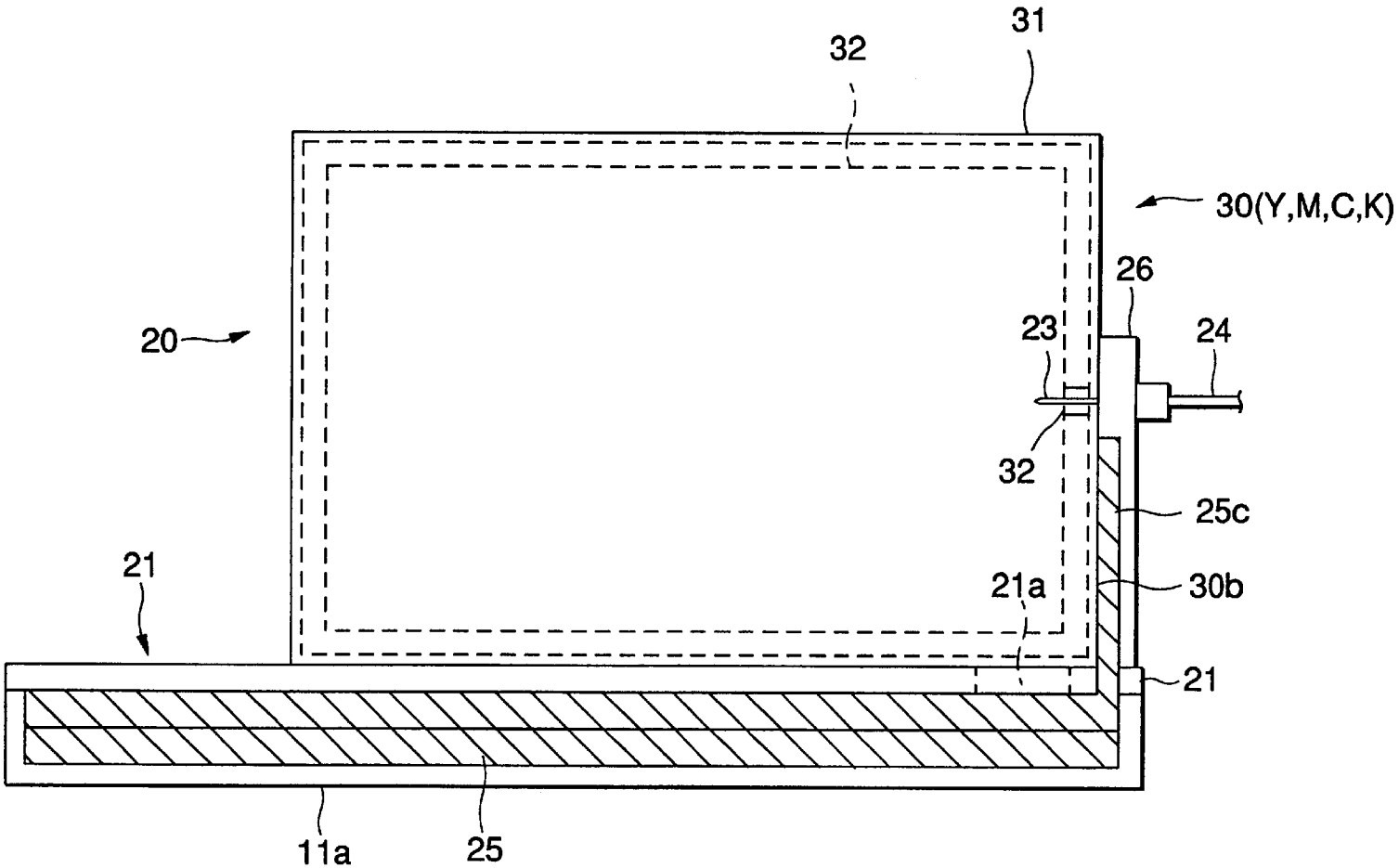
FIG. 22 is a partial sectional side view showing the main part of a part in which cartridges are installed in a seventeenth embodiment of the ink-jet printer according to the present invention.

FIG. 22 is a partial sectional side view showing the main part of a cartridge installed part in a seventeenth embodiment of the ink-jet printer according to the present invention. In FIG. 22, the same reference number is allocated to the same part or an equivalent part as to that in the above ninth embodiment.

This embodiment is characterized in that an ink absorber 25*c* for absorbing ink dropped from an ink supply needle 23 is secured to a standing wall 26 to which the ink supply needle 23 is provided. This embodiment is also characterized in that the front 30*b* of a cartridge in a direction in which the cartridge is installed is constituted so that the front is in contact with the ink absorber 25*c* (lightly pressed on the ink absorber in this embodiment) with the cartridge 30 installed in the installed part 20. Further, this embodiment is characterized in that the ink absorber 25*c* is constituted by a part 25*c* of a waste ink absorber 25.

According to such an embodiment, as the ink absorber 25*c* for absorbing ink dropped from the ink supply needle 23 is provided to the standing wall 26 to which the ink supply needle 23 is provided, ink dropped from the ink supply needle 23 is absorbed by the ink absorber 25*c*.

Therefore, the front 30*b* of the particular cartridge 30 is never excessively contaminated.

Further, as the front 30*b* of the cartridges in the installed direction is constituted so that the front is in contact with the ink absorber 25*c* with the cartridges 30 installed in the installed part 20, the front 30*b* of the cartridges is more securely prevented from being extremely contaminated.

In detailed description, when the cartridges 30 are extracted from the installed part 20, an ink droplet often adheres to particularly the lower surface of the ink supply needle 23. In such a case, when for example, a new cartridge is installed without taking any measure, the above ink droplet drops on the front 30*b* of the cartridge in the above installed process, adheres to the front and hereby, the front 30*b* of the cartridge is often contaminated.

In the meantime, according to this embodiment, as the front 30*b* of the cartridges 30 is constituted so that it is in contact with the ink absorber 25*c* with the cartridges 30 installed in the installed part 20, ink is absorbed by the ink absorber 25*c* even if the above ink droplet adheres to the front 30*b* in a process in which the cartridges 30 are installed.

Therefore, the front 30*b* of each cartridge 30 is more securely prevented from being excessively contaminated.

In addition, as the ink absorber 25*c* is constituted by a part 25*c* of the waste ink absorber 25, an ink absorber is not required to be provided separately except the waste ink absorber 25. Therefore, the front of each cartridge 30 can be prevented from being extremely contaminated without increasing the number of parts.

Eighteenth Embodiment

In the above first to seventeenth embodiments, ink is forcedly discharged outside the head by the pump.

In this eighteenth embodiment, when the quantity of discharged ink according to the rotational speed of the pump reaches predetermined quantity, a message that the waste ink absorber 25 should be replaced is given to a user on the display 17 (see FIG. 1).

More specifically, when the cumulative number of revolutions of the pump reaches the predetermined number of revolutions as determined by the counter C of the pump P, a message that the waste ink absorber 25 should be replaced is given to a user.

The cumulative number of revolutions of the pump can be controlled by a control section (not shown) with which the printer is provided and the above message can be displayed on a display (not shown) with which the printer is provided and others. The cumulative number of revolutions of the pump is constituted so that it is reset when the waste ink absorber 25 is replaced with a new one.

According to this embodiment, as a message that the waste ink absorber 25 should be replaced is given to a user when the quantity of discharged ink according to the rotational speed of the pump reaches predetermined quantity, the waste ink absorber 25 is replaced with a new one before the supper surface of the waste ink absorber 25 is filled with ink.

Therefore, a situation that ink overflows from the waste ink absorber 25 can be prevented beforehand.

In addition, in the embodiments constituted so that the bottom face of each cartridge 30 is wiped by the waste ink absorber 25, the effect of the wipe can be secured.

The embodiments of the present invention are described above, however, the present invention is not limited to the above embodiments and can be suitably varied in a range of the outline of the present invention.

The constitutions in the above embodiments can be suitably combined.

What is claimed is:

1. An ink-jet printer, comprising:

a printer body including a cartridge installed part;

an ink jet head provided on the printer body for jetting an ink droplet from a nozzle; and plural ink cartridges detachably installed on said installed part for supplying ink to said ink jet head with said plural ink cartridges installed, wherein:

each of said plural ink cartridges are provided with a holding part at one end thereof; and said ends of said plural ink cartridges are arranged in a staircase manner with said plural ink cartridges installed in said installed part.

2. An ink-jet printer according to claim 1, wherein:

said plural ink cartridges are cartridges for supplying ink of different colors;

said plural ink cartridges include a first ink cartridge which supplies ink of a color used most frequently and said first cartridge is the largest.

3. An ink-jet printer according to claim 1, wherein:

said plural ink cartridges are cartridges for supplying ink of different colors, each of said plural ink cartridges having a size; and said size of said plural ink cartridges are arranged so that said sizes are proportional to the amount of ink supplied by each of said plural ink cartridges.

4. An ink-jet printer according to claim 1, wherein:

each of said holding parts includes a finger grasping part for grasping with fingers when one of said plural ink cartridges is detached from said installed part; and finger grasping sides of said finger grasping parts are formed on the side on which said one end is not opposed by an adjacent cartridge.

5. An ink-jet printer, comprising:

a printer body including a cartridge installed part;

an ink jet head provided on the printer body for jetting an ink droplet from a nozzle; and plural ink cartridges detachably installed on said installed part for supplying ink to said ink jet head with said plural ink cartridges installed, wherein:

said plural ink cartridges are provided with a holding part at one end thereof; and said ends are arranged in a zigzag pattern with said plural ink cartridges installed in said installed part.

6. An ink-jet printer according to claim 5, wherein:

said holding part is constituted as a finger grasping part for grasping with fingers when one of said plural ink cartridges is detached from said installed part; and a finger grasping side of said finger grasping part are formed on a side on which said one end is not opposed by an adjacent cartridge.

7. An ink-jet printer, comprising:

a printer body including a cartridge installed part;

an ink jet head provided on said printer body for jetting an ink droplet from a nozzle; and at least two ink cartridges detachably installed on said installed part for supplying ink to said ink jet head with said ink cartridges installed, wherein:

said at least two ink cartridges are provided with a finger grasping part for grasping with fingers when a cartridge is detached from said installed part at one end thereof; and a finger grasping side of said finger grasping part of said at least two cartridges is formed on a side on which said ends are not opposed by an adjacent cartridge.

8. An ink-jet printer, comprising:

a printer body including an installed part;

an ink jet head provided on said printer body for jetting an ink droplet from a nozzle; and plural ink cartridges detachably installed on said installed part for supplying ink to said ink jet head with said plural ink cartridges installed, wherein:

each end on the side on which said plural ink cartridges are installed of said plural ink cartridges is arranged in a staircase manner with said plural ink cartridges installed in said installed part.

9. An ink-jet printer, comprising:

a printer body including an installed part;

an ink jet head provided on said printer body for jetting an ink droplet from a nozzle; and plural ink cartridges detachably installed on said installed part for supplying ink to said ink jet head with said plural ink cartridges installed, wherein:

each of said plural ink cartridges are provided with a holding part at one end thereof;

said one ends are arranged like a staircase when said plural ink cartridges are installed in said installed part; and opposite ends which are opposite said one ends, on the side on which said plural ink cartridges are installed, are also arranged like a staircase.

10. An ink-jet printer, comprising:

a printer body including an installing part;

an ink jet head provided with a nozzle for jetting an ink droplet therefrom;

an ink cartridge detachably installed in said installing part;

an ink supply needle for supplying ink from said ink cartridge to said ink jet head;

an ink discharge port from which waste ink from said ink jet head is discharged; and a common waste ink absorber for absorbing ink, wherein:

said ink supply needle and said discharge port are arranged so as to prevent a local saturation absorption state of said common waste ink absorber.

11. An ink-jet printer according to claim 10, wherein:

ink dropped from said ink supply needle and ink discharged from the nozzle of said ink jet head outside the head are absorbed in said waste ink absorber from separate sides of said waste ink absorber.

12. An ink-jet printer according to claim 11, further including a waste ink tube having an end disposed under said waste ink absorber.

13. An ink-jet printer according to claim 12, wherein said end of said waste ink tube is arranged on a rear side of the waste ink absorber.

14. An ink-jet printer according to claim 10, wherein:

a first drain opening for receiving ink dropped from said ink supply needle is formed on said bottom plate; and an ink passage for leading ink from said opening to said waste ink absorber is provided.

15. An ink-jet printer according to claim 14, wherein:

a plurality of second drain openings are provided in a direction in which said ink cartridge is installed or detached.

16. An ink-jet printer according to claim 15, wherein:

a width of at least one of said plurality of drain openings is wider than a width of said ink cartridge.

17. An ink-jet printer according to claim 10, wherein:

said installed part is provided with a bottom plate on which said ink cartridge is positioned;

a drain opening for receiving ink dropped from said ink supply needle is formed on said bottom plate; and said waste ink absorber is arranged under said bottom plate.

18. An ink-jet printer according to claim 17, wherein:

an upper surface of said waste ink absorber is in contact with at least a part of the lower surface of said bottom plate.

19. An ink-jet printer according to claim 18, wherein:

said part is a lower part of an edge at least partially defining said drain opening.

20. An ink-jet printer according to claim 17, wherein:

a first part of said waste ink absorber is disposed on a same plane as an upper surface of said bottom plate.

21. An ink-jet printer according to claim 20, wherein:

a second part of said waste ink absorber is pressed upon a bottom face of an ink cartridge installed in said installed part.

22. An ink-jet printer according to claim 17, wherein:

a plurality of said drain openings are provided in a direction in which an ink cartridge is installed or detached.

23. An ink-jet printer according to claim 22, wherein:

a width of at least one of said plurality of drain openings is wider than a width of an ink cartridge.

24. An ink-jet printer according to claim 22, further including at least one ink passage leading from said plurality of drain openings to said ink absorber, said at least one ink passage being integrated with said bottom plate.

25. An ink-jet printer, comprising:

a printer body including an installed part;

an ink jet head provided on said printer body for jetting an ink droplet from a nozzle; and an ink cartridge detachably installed on said installed part for supplying ink to said ink jet head via an ink supply needle provided on said installed part with said ink cartridge installed, wherein:

said ink supply needle is secured to a standing wall in said installed part; and an ink absorber for absorbing ink dropped from said ink supply needle is provided on said standing wall.

26. An ink-jet printer according to claim 25, wherein:

a front of an ink cartridge in a direction in which said ink cartridge is installed is in contact with said ink absorber with said ink cartridge installed in said installed part.

27. An ink-jet printer according to claim 25, comprising:

a waste ink absorber for absorbing ink forcedly discharged outside the head via a nozzle when the nozzle of said ink jet head is clogged, wherein:

a part of said waste ink absorber constitutes said ink absorber provided on said standing wall.

28. An ink-jet printing method comprising the steps of:

ejecting ink through nozzles in an ink jet head toward a recording medium;

forcibly removing ink from one of said nozzles by a pump when said one of said nozzles becomes clogged;

discharging the ink forcibly removed into a waste ink absorber as discharged ink;

counting the number of cumulative revolutions of said pump;

displaying a message indicating that said waste ink absorber should be replaced when said number of cumulative revolutions exceeds a predetermined number of revolutions, and replacing said waste ink absorber when the message is displayed.

29. An ink-jet printer comprising:

an ink jet head including nozzles through which ink is ejected toward a recording medium;

a pump which forcibly removes ink from said nozzles when said nozzles become clogged;

a waste ink absorber which stores the ink that has been forcibly removed as discharged ink;

a counter for counting the number of cumulative revolutions of said pump;

a display for displaying a message indicating that said waste ink absorber should be replaced when said number of cumulative revolutions exceeds a predetermined number of revolutions, wherein;

said waste ink absorber is replaced when the message is displayed.

* * * * *